US006586364B2

(12) United States Patent
Kubota et al.

(10) Patent No.: US 6,586,364 B2
(45) Date of Patent: Jul. 1, 2003

(54) HEAT-SENSITIVE MICROCAPSULE AND RECORDING MEDIUM USING SAME

(75) Inventors: Yukio Kubota, Saitama-ken (JP); Minoru Suzuki, Tochigi-ken (JP); Kazuyuki Shimbo, Kanagawa-ken (JP); Yutaka Igari, Fukushima-ken (JP)

(73) Assignee: Pentax Corporation, Tokyo (JP)

( * ) Notice: Subject to any disclaimer, the term of this patent is extended or adjusted under 35 U.S.C. 154(b) by 40 days.

(21) Appl. No.: 09/730,599

(22) Filed: Dec. 7, 2000

(65) Prior Publication Data

US 2002/0168580 A1 Nov. 14, 2002

(30) Foreign Application Priority Data

Dec. 8, 1999 (JP) ..... 11-348908
Apr. 21, 2000 (JP) ..... 2000-121552

(51) Int. Cl.[7] ..... B41M 5/30

(52) U.S. Cl. ..... 503/215; 428/321.5; 428/402.21; 428/402.22; 503/204; 503/213

(58) Field of Search ..... 503/204, 215, 503/213; 428/321.5, 402.2, 402.21, 402.22

(56) References Cited

U.S. PATENT DOCUMENTS

| | | | | |
|---|---|---|---|---|
| 4,369,065 | A | 1/1983 | Brixius | 106/27 |
| 4,644,376 | A | 2/1987 | Usami et al. | 503/215 |
| 6,105,502 | A | 8/2000 | Wagner et al. | 101/491 |
| 6,139,914 | A | 10/2000 | Suzuki et al. | 427/213.3 |

FOREIGN PATENT DOCUMENTS

| | | |
|---|---|---|
| JP | 55102290 | 8/1980 |
| JP | 58-33492 | 2/1983 |
| JP | 58-63424 | 4/1983 |
| JP | 58-82785 | 5/1983 |
| JP | 60242093 | 12/1985 |
| JP | 61137787 | 6/1986 |

OTHER PUBLICATIONS

English Language Abstract for JP 55–102290.
English Language Abstract for JP 58–0063424.
Derwent Abstract of JP–60–006438.

*Primary Examiner*—B. Hamilton Hess
(74) *Attorney, Agent, or Firm*—Greenblum & Bernstein, P.L.C.

(57) ABSTRACT

A first heat-sensitive microcapsule of the present invention comprises a shell wall and a liquid coloring composition, and has such a temperature-breaking characteristic that the shell wall is broken by heating to a temperature equal to or higher than a boiling point of the liquid coloring composition. The first heat-sensitive microcapsule is stable to light and easy to handle. A second heat-sensitive microcapsule of the present invention comprises a shell wall, a coloring composition and a heat decomposition-type gas-developing agent, and has such a temperature-breaking characteristic that the shell wall is broken by heating to a temperature equal to or higher than a decomposition temperature of the gas-developing agent. The second heat-sensitive microcapsule can be sensitively broken even by heating in a short time. A heat-sensitive recording medium comprising the first or second heat-sensitive microcapsule provides substantially no waste products after recording, is easy to handle, and capable of economically recording an image with ease.

17 Claims, 22 Drawing Sheets

HEAT-SENSITIVE MICROCAPSULE AND RECORDING MEDIUM USING SAME

BACKGROUND OF THE INVENTION

The present invention relates to heat-sensitive microcapsules that are broken by heating to a predetermined temperature, and recording mediums using the heat-sensitive microcapsules.

Recording mediums comprising a substrate such as a paper sheet coated with microcapsules containing a coloring composition have been well known. Known as an example thereof are photo-sensitive recording mediums using photo-sensitive microcapsules comprising a shell wall of a photo-setting resin. The photo-sensitive recording mediums are exposed to light correspondingly to a desired image pattern and applied a predetermined pressure to, thereby recording images. Thus, the photo-sensitive microcapsules not exposed to light are broken and the microcapsules exposed to light, photo-set microcapsules, are not broken by the pressure, whereby on a layer of the microcapsules is recorded an image corresponding to the light exposure pattern.

However, the photo-sensitive recording mediums must be produced and stored in a light-screening environment to prevent the photo-sensitive microcapsules from photosetting. On the photo-sensitive recording mediums must be recorded images in such an environment. Further, because the photo-sensitive microcapsules not exposed to light are broken with ease, the photo-sensitive recording mediums comprising the photo-sensitive microcapsules must be handled without external force. Therefore, the photo-sensitive recording mediums are put in a light-screening package, etc. to store, thereby increasing costs and size of a recording device using the mediums. The light-screening package, etc. is disposed as a waste product.

Heat-sensitive recording mediums using heat-sensitive microcapsule that is broken by heating to a predetermined temperature are also known. The heat-sensitive microcapsule may contain a diazo compound, a colorless leuco-dye such as a fluoran compound, etc. as a color-producing agent. In the case of the heat-sensitive microcapsule containing the leuco-dye, the heat-sensitive microcapsule is heated to melt its shell wall or to make the leuco-dye permeate through the shell wall, whereby the leuco-dye comes into contact with a color-developing agent such as Bisphenol A to exhibit color. In the case of the heat-sensitive microcapsule containing the diazo compound, a coupler may be used instead of the color-developing agent. The heat-sensitive microcapsule may contain the color-developing agent or the coupler. The heat-sensitive microcapsule releases the color-developing agent or the coupler by heating to make it come in contact with the leuco-dye or the diazo compound. Thus, the color-producing agent is stably isolated from the color-developing agent or the coupler. Polyurea/polyurethane microcapsules, gelatin microcapsules, U/F (urea/formalin) microcapsules, M/F (melamine/formalin) microcapsules, etc. are known as such a heat-sensitive microcapsule.

With regard to the heat-sensitive recording medium mentioned above, the color-producing agent interacted with the color-developing agent or the coupler is generally fixed to the substrate by irradiating a particular light such as ultra-violet. The image-recording device using the heat-sensitive recording medium is required to have a light irradiation unit, thereby inevitably increasing power consumption. Further, in the case where a color image is recorded on the heat-sensitive recording medium, heating and light irradiation must be repeatedly carried out to every color, failing to rapidly form the color image. Furthermore, above-described heat-sensitive microcapsules are insufficient in heat-responsiveness so that the shell wall thereof is not sensitively melted. Thus, although the heat-sensitive microcapsules have known as a general idea, there is no example of the microcapsules that can be sensitively broken even by heating in a short time. Further, the reaction between the leuco-dye and the color-developing agent is reversible, whereby the heat-sensitive recording mediums using the leuco-dye are generally poor in stability of recorded image and reliability.

OBJECT AND SUMMARY OF THE INVENTION

Accordingly, a first object of the present invention is to provide a first heat-sensitive microcapsule stable to light and easy to handle.

A second object of the present invention is to provide a second heat-sensitive microcapsule that is sensitively broken even by heating in a short time.

A third object of the present invention is to provide recording mediums comprising a heat-sensitive microcapsule, which provides substantially no waste products after recording, is easy to handle, and capable of economically recording an image with ease.

As a result of intense research in view of the first object, the inventors have found that a novel microcapsule comprising a liquid coloring composition, which is broken by its increased internal pressure provided by heating to a temperature equal to or higher than a boiling point of the liquid coloring composition, is stable to light and easy to handle. Thus, a first heat-sensitive microcapsule of the present invention comprises a shell wall and a liquid coloring composition enclosed in the shell wall, and has such a temperature-breaking characteristic that the shell wall is broken by heating to a temperature equal to or higher than a boiling point of the liquid coloring composition to release the liquid coloring composition. The first heat-sensitive microcapsule of the present invention is broken to release its enclosures not by melt of the shell wall, but by increased inner pressure provided by vaporization of the liquid coloring composition, being deferent from conventional heat-sensitive microcapsules.

As a result of intense research in view of the second object, the inventors have found that a heat-sensitive microcapsule containing at least a gas-developing agent and a coloring composition is sensitively broken even by heating in a short time. Thus, a second heat-sensitive microcapsule of the present invention comprises a shell wall, and a coloring composition and a heat decomposition-type gas-developing agent enclosed in the shell wall, and has such a temperature-breaking characteristic that the shell wall is broken by heating to a temperature equal to or higher than a decomposition temperature of the heat decomposition-type gas-developing agent to release the coloring composition. In the second heat-sensitive microcapsule of the present invention, the gas-developing agent is decomposed at a temperature equal to or higher than its decomposition temperature to provide $N_2$ gas, etc., thereby increasing the inner pressure of the microcapsule. Therefore, the shell wall of the microcapsule is sensitively broken by the increased inner pressure to fix the coloring composition to the substrate. The second heat-sensitive microcapsule of the present invention is broken to release its enclosures not by melt of the shell wall, but by increased inner pressure provided by decomposition of the gas-developing agent, being deferent from conventional heat-sensitive microcapsules.

A first recording medium of the present invention is a heat-sensitive recording medium comprising a substrate coated with a microcapsule layer including the first heat-sensitive microcapsule. The first recording medium is capable of economically recording a single color image with ease.

A second recording medium of the present invention is a heat-sensitive recording medium comprising a substrate coated with a microcapsule layer including the second heat-sensitive microcapsule. The second recording medium is capable of economically recording a single color image with ease.

A third recording medium of the present invention is a pressure-sensitive, heat-sensitive recording medium comprising a substrate coated with a microcapsule layer. The microcapsule layer comprises upper, middle and lower portions, the lower portion being disposed on the substrate, the middle portion being disposed on the lower portion, the upper portion being disposed on the middle portion. The upper portion includes a plurality of first pressure-sensitive microcapsules uniformly distributed in a first binder having a predetermined melting temperature, the first pressure-sensitive microcapsules each containing a first coloring composition. The middle portion includes a plurality of second pressure-sensitive microcapsules uniformly distributed in a second binder having a melting temperature higher than the melting temperature of the first binder, the second pressure-sensitive microcapsules each containing a second coloring composition. The lower portion includes a plurality of third pressure-sensitive microcapsules and a plurality of heat-sensitive microcapsules uniformly distributed in a third binder having a melting temperature higher than the melting temperature of the second binder, the third pressure-sensitive microcapsules each containing a third coloring composition, the heat-sensitive microcapsules each containing a fourth coloring composition. The first pressure-sensitive microcapsule is broken under a first pressure at a first temperature higher than the melting temperature of the first binder, the second pressure-sensitive microcapsule is broken under a second pressure lower than the first pressure at a second temperature higher than the melting temperature of the second binder, the third pressure-sensitive microcapsule is broken under a third pressure lower than the second pressure at a third temperature higher than the melting temperature of the third binder, and the heat-sensitive microcapsule has such a temperature-breaking characteristic that the heat-sensitive microcapsule is broken by heating to a fourth temperature higher than the third temperature to release the fourth coloring composition. As the heat-sensitive microcapsule, the first or second heat-sensitive microcapsule of the present invention may be preferably used. The third recording medium is capable of economically recording a color image with ease.

A fourth recording medium of the present invention is a pressure-sensitive, heat-sensitive recording medium comprising a substrate coated with a microcapsule layer. The microcapsule layer comprises upper and lower portions, the lower portion being disposed on the substrate, the upper portion being disposed on the lower portion. The upper portion includes a plurality of first pressure-sensitive microcapsules uniformly distributed in a first binder having a predetermined melting temperature, the first pressure-sensitive microcapsules each containing a first coloring composition. The lower portion includes a plurality of second pressure-sensitive microcapsules and a plurality of heat-sensitive microcapsules uniformly distributed in a second binder having a melting temperature higher than the melting temperature of the first binder, the second pressure-sensitive microcapsules each containing a second coloring composition, the heat-sensitive microcapsules each containing a third coloring composition. The first pressure-sensitive microcapsule is broken under a first pressure at a first temperature higher than the melting temperature of the first binder, the second pressure-sensitive microcapsule is broken under a second pressure lower than the first pressure at a second temperature higher than the melting temperature of the second binder, and the heat-sensitive microcapsule has such a temperature-breaking characteristic that the heat-sensitive microcapsule is broken by heating to a third temperature higher than the second temperature to release the third coloring composition. As the heat-sensitive microcapsule, the first or second heat-sensitive microcapsule of the present invention may be preferably used. The fourth recording medium is capable of economically recording a color image with ease.

A fifth recording medium of the present invention is a pressure-sensitive, heat-sensitive recording medium comprising a substrate coated with a microcapsule layer. The microcapsule layer includes a plurality of pressure-sensitive microcapsules and a plurality of heat-sensitive microcapsules uniformly distributed in a binder having a predetermined melting temperature, the pressure-sensitive microcapsules each containing a first coloring composition, the heat-sensitive microcapsules each containing a second coloring composition. The pressure-sensitive microcapsule is broken under a predetermined pressure at a first temperature higher than the melting temperature of the binder, and the heat-sensitive microcapsule has such a temperature-breaking characteristic that the heat-sensitive microcapsule is broken by heating to a second temperature higher than the first temperature to release the second coloring composition. As the heat-sensitive microcapsule, the first or second heat-sensitive microcapsule of the present invention may be preferably used. The fifth recording medium is capable of economically recording a color image with ease.

A sixth recording medium of the present invention is a pressure-sensitive, heat-sensitive recording medium comprising a substrate coated with a microcapsule layer. The microcapsule layer includes a plurality of first pressure-sensitive microcapsules, a plurality of second pressure-sensitive microcapsules and a plurality of heat-sensitive microcapsules uniformly distributed in a binder having a predetermined melting temperature, the first pressure-sensitive microcapsules each containing a first coloring composition, the second pressure-sensitive microcapsules each containing a second coloring composition, the heat-sensitive microcapsules each containing a third coloring composition. The first pressure-sensitive microcapsule is broken under a first pressure at a first temperature higher than the melting temperature of the binder, the second pressure-sensitive microcapsule is broken under a second pressure lower than the first pressure at a second temperature higher than the first temperature, and the heat-sensitive microcapsule has such a temperature-breaking characteristic that the heat-sensitive microcapsule is broken by heating to a third temperature higher than the second temperature to release the third coloring composition. As the heat-sensitive microcapsule, the first or second heat-sensitive microcapsule of the present invention may be preferably used. The sixth recording medium is capable of economically recording a color image with ease.

DETAILED DESCRIPTION OF THE PREFERRED EMBODIMENTS

[1] Heat-sensitive Microcapsule

Figure 1:
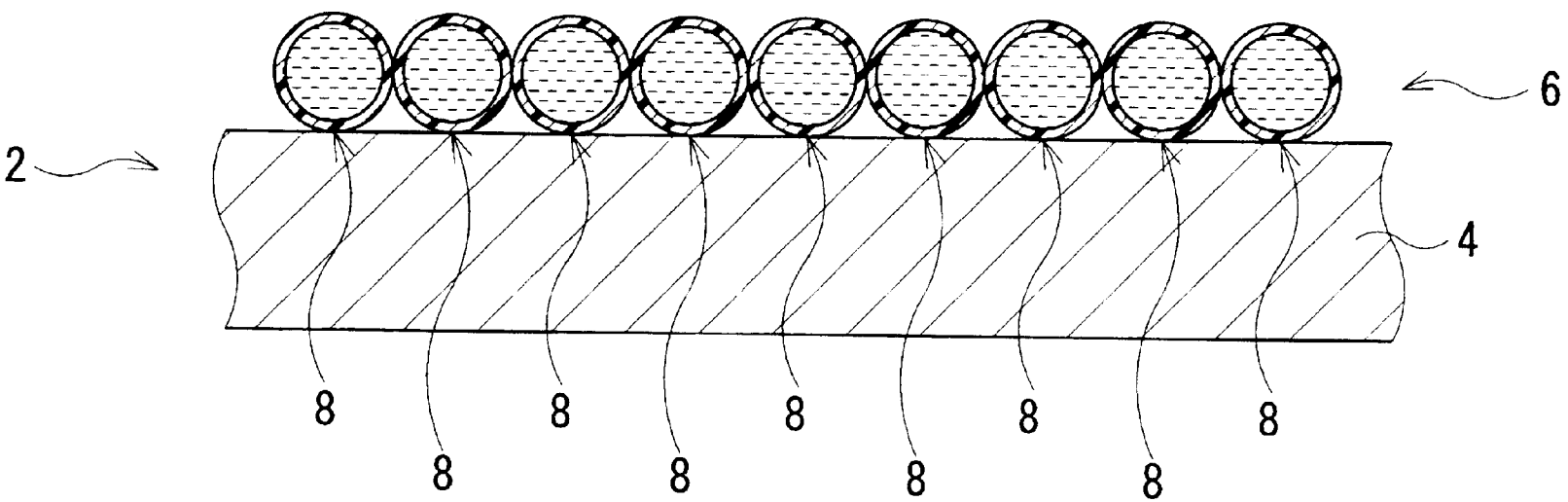
FIG. 1 is a partial, schematic, cross-sectional view showing an embodiment according to the first recording medium of the present invention.

First and second heat-sensitive microcapsules of the present invention are described below.

[A] First Heat-sensitive Microcapsule

A first heat-sensitive microcapsule comprises a shell wall and a liquid coloring composition enclosed in the shell wall, and has such a temperature-breaking characteristic that the shell wall is broken by heating to a temperature equal to or higher than a boiling point of the liquid coloring composition to release the liquid coloring composition. The first heat-sensitive microcapsule of the present invention is broken to release its enclosures not by melt of the shell wall, but by inner pressure that is increased by vaporizing the liquid coloring composition. In general, although the first heat-sensitive microcapsule has relatively excellent strength against external pressure, the first heat-sensitive microcapsule is easily broken by the increased inner pressure at a temperature more than the boiling point of the coloring composition. In this specification, "coloring composition" means compositions containing a color-exhibiting compound, or a compound that exhibits a color by reacting with the other compound. Thus, the term "coloring composition" includes a color-producing agent and a color-developing agent.

(1) Liquid Coloring Composition

The liquid coloring composition preferably contains a liquid vehicle and a coloring matter dispersed or dissolved in the liquid vehicle.

The liquid vehicle is preferably a transparent oil, particularly preferably a high-boiling point oil such as "KMC-113" (2,7-diisopropyl naphthaline, boiling point: approximately 300° C.) manufactured by Rutgers Kreha Solvents Gmbh., etc. The high-boiling point oil may comprise a compound for controlling the boiling point of the liquid coloring composition. For example, in the case of using KMC-113 as the high-boiling point oil, n-heptane, xylene, benzene, naphthaline, etc. may be added thereto to control its boiling point.

The coloring matter used in the first heat-sensitive microcapsule is not particularly limited, may be carbon black, ink exhibiting a color, conventional color-producing systems, etc. Examples of the color-producing system include: combinations of leuco color-producing agents and color-developing agents such as phenol derivatives, salicylic acid derivatives, metal salts of aromatic carboxylic acids, acid clays, bentonites, novolac resins, metal-treated novolac resins, metal complexes; combinations of diazo compounds and couplers that interact therewith via coupling reaction; combinations of nucleophilic agents and compounds interact therewith via elimination reaction; etc. One of the two elements composing the color-producing system may be contained in the fist heat-sensitive microcapsule and released from the microcapsule by heating, thereby coming into contact with the other element to exhibit color. Also, the two elements may be both contained in the first heat-sensitive microcapsule in the case where the color-producing system is inactive at an ordinary temperature.

Specifically, the liquid coloring composition may be a black coloring composition obtained by adding n-heptane to KMC-113 at a n-heptane/KMC-113 volume ratio of 10% to prepare a transparent oil having a primary azeotropic point of approximately 190° C., and by adding approximately 10 weight % of carbon black to 100 weight % of the transparent oil, etc.

(2) Shell Wall

The shell wall of the first heat-sensitive microcapsule according to the present invention may be made of a resin, is preferably made of a thermosetting resin or a high-melting point thermoplastic resin. Thickness of the shell wall may be properly selected such that the shell wall is easily broken by the increased inner pressure at the temperature equal to or higher than the boiling point of the liquid coloring composition enclosed therein to release the coloring composition.

(3) Method for Producing First Heat-sensitive Microcapsule

The first heat-sensitive microcapsule of the present invention may be produced by known microcapsule-producing methods such as coacervation methods, interfacial polymerization methods and in situ polymerization methods described in Japanese Patent Laid-Open Nos. 58-33492 and 58-82785, etc.

[B] Second Heat-Sensitive Microcapsule

A second heat-sensitive microcapsule of the present invention comprises a shell wall, and a coloring composition and a heat decomposition-type gas-developing agent (blowing agent or foaming agent) enclosed in the shell wall, and has such a temperature-breaking characteristic that the shell wall is broken by heating to a temperature equal to or higher than a decomposition temperature of the heat decomposition-type gas-developing agent to release the coloring composition. The second heat-sensitive microcapsule of the present invention is broken to release its enclosures not by melt of the shell wall, but by inner pressure that is increased by the heat decomposition-type gas-developing agent. Although the second heat-sensitive microcapsule of the present invention is not broken by applying pressure or by heating during storage or transport to stably maintain its enclosures, the second heat-sensitive microcapsule is entirely or partially broken by increased inner pressure to release its enclosures when the heat decomposition-type gas-developing agent contained therein is heated to a predetermined temperature to develop $N_2$ gas, etc.

(1) Heat Decomposition-type Gas-Developing Agent

The heat decomposition-type gas-developing agent used in the present invention, which has a decomposition temperature equal to or lower than the crystalline melting point of the shell wall, is not particularly limited. The heat decomposition-type gas-developing agent is preferably decomposed at 70 to 300° C. to provide a gas.

According to the second heat-sensitive microcapsule of the present invention, breaking temperature may be controlled by selecting the gas-developing agent. The gas-developing agent may be used singly or together with other gas-developing agents. Additives such as gas-developing auxiliaries may be added to the gas-developing agent, to lower the gas-developing temperature, to control amount of gas, etc. Content of the gas-developing agent, which depends on the type thereof, is generally 0.1 to 40 weight %, preferably 0.5 to 20 weight %, more preferably 1 to 15 weight %, based on 100 weight % of the entire enclosures contained in the microcapsule. When the content is less than 0.1 weight %, the amount of developed gas is insufficient, so that the second heat-sensitive microcapsule is insufficient in heat-responsiveness. On the other hand, when the content is more than 40 weight %, it is difficult to encapsulate the gas-developing agent.

(2) Coloring Composition

The coloring composition used for the second heat-sensitive microcapsule contains a coloring matter, may contain a vehicle as well as the liquid coloring composition used for the first heat-sensitive microcapsule mentioned above.

The coloring matter used in the second heat-sensitive microcapsule is not particularly limited, may be carbon black, an ink exhibiting a color, conventional color-producing systems described above, etc. One of the two elements composing the color-producing system may be contained in the second heat-sensitive microcapsule and released from the microcapsule by heating, thereby coming into contact with the other element to exhibit color. Also, the two elements may be both contained in the second heat-sensitive microcapsule in the case where the color-producing system is inactive at an ordinary temperature.

The color-producing system preferably used for the second heat-sensitive microcapsule is such as utilizing a reaction between an oxidative color-producing leuco-dye and a radical-forming, heat decomposition-type, gas-developing agent. In this system, the radical-forming, heat decomposition-type, gas-developing agent serves additionally as the color-developing agent. When the microcapsule containing the radical-forming gas-developing agent and the leuco-dye is heated, the gas-developing agent provides radicals, the radicals momentarily and rapidly react with the leuco-dye to exhibit color, and immediately thereafter, the microcapsule is broken by developed gas to release the colored leuco-dye. This system is excellent in a degree of color-developing. This system comprises the irreversible reaction between the gas-developing agent and the leuco-dye, thereby improving recording reliability and quality of the recorded image.

Examples of the radical-forming, heat decomposition-type gas-developing agent used with the oxidative color-producing leuco-dye include: azo gas-developing agents such as azodicarbonamide (ADCA), azobisisobutyronitrile (AIBN), 4,4'-azobiscyano valeric acid, t-butyl azoformamide, 2,4-bis(azosulfonyl) toluene, 2,2'-azobisisobutyro amide, methyl-2,2'-azobisisobutylate, 2-(carbamoylazo)isobutyronitrile and 1,1'-azobiscyclohexane carbonitrile; nitroso gas-developing agents such as N,N'-dinitrosopentamethylene tetramine (DPT) and N,N'-dinitroso-N',N'-dimethyl terephthalamide; sulfonyl hydrazide gas-developing agents such as p-benzenesulfonyl hydrazide, p-toluenesulfonyl hydrazide (TSH) and p,p'-oxybis(benzenesulfonyl hydrazide) (OBSH); etc.

Among them, particularly preferred are azodicarbonamide (ADCA), azobisisobutyronitrile (AIBN), N,N'-dinitrosopentamethylene tetramine (DPT), p-toluenesulfonyl hydrazide (TSH) and p,p'-oxybis (benzenesulfonyl hydrazide) (OBSH). The decomposition temperatures thereof are shown in Table 1.

TABLE 1

| Decomposition temperature of radical-forming, heat decomposition-type gas-developing agent | |
|---|---|
| Heat decomposition-type gas-developing agent | Decomposition Temperature |
| ADCA | 200 to 210° C. |
| AIBN | 100 to 102° C. |
| DPT | 200 to 205° C. |
| TSH | 103 to 107° C. |
| OBSH | 155 to 160° C. |

The radical-forming agent should be appropriately selected depending on the leuco-dye because there is a case where the color of the leuco-dye is unavoidably changed by the radical-forming agent.

The oxidative color-producing leuco-dye is generally colorless or light-colored compound that is colorized by oxidation. Examples of the oxidative color-producing leuco-dye include aminotriarylmethane compounds, aminoxanthene compounds, aminothioxanthene compounds, amino-9,10-dihydro acridine compounds, aminophenoxazine compounds, aminophenothiazine compounds, aminodihydrophenazine compounds, aminodiphenylmethane compounds, leuco indamines, aminohydrocinnamic acid compounds, hydrazine compounds, leuco indigoid dyes, amino-2,3-dihydro anthraquinone compounds, tetrahalo-p, p'-biphenol compounds, 2-(p-hydroxyphenyl)-4,5-diphenylimidazole compounds, phenethylaniline compounds, alkoxyxanthene compounds, etc. described in Japanese Patent Publication No. 2-14353, Japanese Patent Laid-Open No. 62-198494, U.S. Pat. No. 3,445,234, etc. These compounds are transformed into a color-exhibiting structure by taking away one or two hydrogen atom therefrom. Among them, aminotriarylmethane compounds, aminodiphenylmethane compounds, aminoxanthene compounds, aminophenothiazine compounds, aminophenoxazine compounds and alkoxyxanthene compounds are preferable from the viewpoints of a color-producing sensitivity and color-fixing properties.

Specific examples of the oxidative color-producing leuco-dye include 3,7-bis(dimethylamino)-10-benzoylphenothiazine, 3,7-bis(dimethyl amino)-10-(p-toluoyl)phenothiazine, 3,7-bis(dimethylamino)-10-pivaloylphenothiazine, 3,7-bis(diethylamino)-10-benzoylphenothiazine, 3,7-bis(diethylamino )-10-(p-toluoyl)phenoxazine, tris(4-dimethylaminophenyl)methane, bis(4-dimethylaminophenyl)methane, tris(4-diethylaminophenyl)methane, tris(4-dimethylamino-2-methylphenyl)methane, tris(4-diethylamino-2-methylphenyl)methane, bis(4-dimethylaminophenyl)-(4-diethylaminophenyl)methane, bis(4-diethylamino-2-methylphenyl)-(4-diethylaminophenyl)methane, bis(4-dimethylamino-2-methylphenyl)-(4-dimethylaminophenyl)methane, bis(4-dimethylaminophenyl)-(2-methoxycarbonylphenyl)methane, bis(4-dimethylaminophenyl)-(4-dimethylamino-2-methoxycarbonylphenyl)methane, (4-dimethylaminophenyl)-(4-diethylamino-2-methylphenyl)-(4-dimethylamino-2-methoxycarbonylphenyl)methane, bis(1-ethyl-2-methylindole-3-yl)-(2-methoxycarbonylphenyl)methane, bis(1-methyl-2-phenylindole-3-yl)-(2-methoxycarbonylphenyl)methane, (2-methyl-4-dimethylaminophenyl)-(1-ethyl-2-methylindole-3-yl)-(2-methoxycarbonylphenyl)methane, (2-methyl-4-dimethylaminophenyl)-(1-ethyl-2-methylindole-3-yl)-(2-butoxycarbonylphenyl)methane, (2-methyl-4-diethylaminophenyl)-(1-ethyl-2-methylindole-3-yl)-(2-methoxycarbonylphenyl)methane, (2-methoxy-4-dimethylaminophenyl)-(1-ethyl-2-methylindole-3-yl)-(2-methoxycarbonylphenyl)methane, (2-methyl-4-dimethylaminophenyl)-(1-methyl-2-phenyl-indole-3-yl)-(2-methoxycarbonylphenyl)methane, (2-methyl-4-dimethylaminophenyl)-(1-ethyl-2-methylindole-3-yl)-(3-methoxycarbonyl-2-pyridyl)methane, (2-methyl-4-dimethylaminophenyl)-(1-ethyl-2-methylindole-3-yl)-(3-butoxycarbonyl-2-pyridyl)methane, (2-methyl-4-diethylaminophenyl)-(1-ethyl-2-methylindole-3-yl)-(3-methoxycarbonyl-2-pyridyl)methane, (2-methyl-4-diethylaminophenyl)-(1-ethyl-2-methylindole-3-yl)-(3-ethoxycarbonyl-2-pyridyl)methane, (2-methoxy-4-dimethylaminophenyl)-(1-ethyl-2-methylindole-3-yl)-(3-methoxycarbonyl-2-pyridyl)methane, (2-methyl-4-dimethylaminophenyl)-(1-methyl-2-phenylindole-3-yl)-(2-methoxycarbonyl-4-methoxy-phenyl)methane, (2-methyl-4-dimethylaminophenyl)-(1-ethyl-2-methylindole-3-yl)-(2-methoxycarbonyl-3,4,5,6-tetrabromophenyl)methane, 3,6-dimethoxy-9-(2-methoxycarbonylphenyl)xanthene, 3,6-dimethoxy-9-(2-ethoxycarbonylphenyl)xanthene, 3,6-dimethoxy-9-(2-butoxycarbonylphenyl)xanthene, 3,6-dibutoxy-9-(2-butoxycarbonylphenyl)xanthene, 8-diethylamino-11-(2-methoxycarbonylphenyl)-benzo[A]xanthene, 8-diethylamino-11-(2-phenoxycarbonylphenyl)-benzo[A]xanthene, 8-diethylamino-11-(2-ethoxycarbonylphenyl)-benzo[A]xanthene, 8-dibutylamino-11-(2-methoxycarbonylphenyl)-benzo[A]xanthene, 8-dibutylamino-11-(2-ethoxycarbonylphenyl)-benzo[A]xanthene, 8-dibutylamino-11-(2-butoxycarbonylphenyl)-benzo [A] xanthene, 3-dibutylamino-6-methyl-7-anilino-9-(2-methoxycarbonylphenyl)xanthene, 3-diethylamino-6-methyl-7-anilino-9-(2-methoxycarbonylphenyl)xanthene, 3-dibutylamino-6-methyl-7-anilino-9-(2-ethoxycarbonylphenyl)xanthene, 3-(N-iso-amyl-N-ethylamino)-6-methyl-7-anilino-9-(2-methoxycarbonylphenyl)xanthene, 3-dibutylamino-7-(o-chloroanilino)-9-(2-methoxycarbonylphenyl)xanthene, 3-dimethylamino-7-(m-trifluoromethylanilino)-9-(2-methoxycarbonylphenyl)xanthene, 3-pyrrolidino-6-methyl-7-anilino-9-(2-methoxycarbonylphenyl)xanthene, 3-piperidino-6-methyl-7-anilino-9-(2-methoxycarbonylphenyl)xanthene, 3-dimethylamino-7-dibenzylamino-9-(2-methoxycarbonylphenyl)xanthene, 3-diethylamino-6-methyl-7-chloro-9-(2-methoxycarbonylphenyl)xanthene, 3-diethylamino-7-chloro-9-(2-methoxycarbonylphenyl)xanthene, 3-dibutylamino-6-methyl-7-chloro-9-(2-ethoxycarbonylphenyl)xanthene, 3-diethylamino-6,7-dimethyl-9-(2-methoxycarbonylphenyl)xanthene, 3-(N-ethyl-p-toluidino)-7-methyl-9-(2-methoxycarbonylphenyl)xanthene, 3-dibutylamino-6-methyl-7-anilino-9-(2-methoxycarbonyl-4-methoxyphenyl)xanthene, 3-dibutylamino-6-methyl-7-anilino-9-(2-methoxycarbonyl-3,4,5,6-tetrachlorophenyl)xanthene, 3,6-bis(dimethylamino)-9-(2-methoxycarbonylphenyl)xanthene, 3,6-bis(diphenylamino)-9-(2-methoxycarbonylphenyl)xanthene, etc. These oxidative color-producing leuco-dyes may be used together with each other.

Content of the leuco-dye is generally 0.1 to 40 weight %, preferably 0.5 to 20 weight %, more preferably 1 to 15 weight % based on 100 weight % of the entire enclosures contained in the second heat-sensitive microcapsule. When the content is less than 0.1 weight %, the color-producing system cannot exhibit sufficient deep color, failing to record a clear image. On the other hand, when the content is more than 40 weight %, it is difficult to encapsulate the leuco-dye.

(3) Shell Wall

The shell wall of the second heat-sensitive microcapsule according to the present invention may be made of, for example, a polymer derived from melamine, thiourea or formaldehyde, etc.

(4) Method for Producing Second Heat-sensitive Microcapsule

The second heat-sensitive microcapsule of the present invention may be produced by known microcapsule-producing methods such as coacervation methods, interfacial polymerization methods and in situ polymerization methods described in Japanese Patent Laid-Open Nos. 58-33492 and 58-82785, etc.

For example, the second heat-sensitive microcapsule may be produced by in situ method described in Japanese Patent Laid-Open No. 58-82785 comprising the steps of: dissolving or dispersing a color-producing agent and a heat decomposition-type gas-developing agent in a water-insoluble, nonvolatile organic solvent such as phosphates, phthalates, fatty amides, alkylated biphenyls, alkylated naphthalenes, diarylethanes, etc. and/or a volatile organic solvent such as toluene, benzene, xylene, ketones, esters, etc. to prepare a color-former solution (core material solution); mixing the color-former solution with a solution comprising at least a water-soluble cationic urea resin and an anionic surface active agent to obtain a mixture; emulsion-dispersing the mixture by a homogenizer, a stirrer, ultrasonics, etc. to obtain micro-droplets with 1 to 8 $\mu$m in size of the color-former solution; adding a prepolymer derived from melamine, thiourea, formaldehyde, etc. thereto as a material for the shell wall to obtain a dispersion; adding an acid catalyst to the dispersion while stirring; and reacting the dispersion at 15 to 60° C. for 2 to 15 hours while controlling pH thereof to 2.5 to 6.0.

To the dispersion may be added water when it is stirred at 15 to 60° C. The prepolymer may be added to the mixture before or while the emulsion dispersing. Amount of the prepolymer is preferably 0.1 to 1 g per the color-former solution of 1 g. Fatty salts, higher alcohol sulfate esters, alkylarylsulfonic acid salts, etc. may be used as the above-mentioned anionic surface active agent. Among them, preferred is sodium dodecylbenzenesulfonate.

[2] Recording Medium

Recording mediums of the present invention is described below.

[A] First Recording Medium

A first recording medium of the present invention is a heat-sensitive recording medium comprising a substrate coated with a microcapsule layer. The microcapsule layer includes the first heat-sensitive microcapsule of the present invention mentioned above.

The first recording medium may be produced by dispersing the heat-sensitive microcapsules in a binder, and by coating the substrate with the dispersion. The microcapsule layer may include the first heat-sensitive microcapsules, the color-developing agent, the color-producing agent, the binder, the loading material, other additives such as wax, antistatic agent, antifoaming agent, conductant agent, fluorescent dye, surface active agent, ultraviolet-absorbing agent, precursors thereof, etc.

Known water-soluble high molecular compounds, latexes, etc. may be used for the binder of the first recording medium. Examples of the water soluble high molecular compound include methylcellulose, carboxymethylcellulose, hydroxyethylcellulose, hydroxypropylcellulose, starch derivatives, casein, gum arabics, gelatin, ethylene-maleic anhydride copolymer, styrene-maleic anhydride copolymer, polyvinylalcohol, modified epichlorohydrin polyamide, isobutylene-maleicsalicylic anhydride copolymer, polyacrylic acid, polyacrylamide, modified compounds thereof, etc. Examples of the latex include styrene-butadiene rubber latex, acrylic acid-methylbutadiene rubber latex, vinyl acetate emulsion, etc.

Known, organic or inorganic loading material may be used for the first recording medium. Specific examples thereof include kaolin, calcined kaolin, talc, pyrophyllite, diatomaceous earth, calcium carbonate, aluminum hydroxide, magnesium hydroxide, zinc oxide, lithopone, amorphous silica, colloidal silica, calcined gypsum, silica, magnesium carbonate, titanium oxide, alumina, barium carbonate, barium sulfate, mica, micro-balloon, urea-formalin filler, polyester particle, cellulose filler, etc.

The substrate may be made of a general heat-sensitive paper, an acidic paper, a neutral paper, a coated paper, a plastic film laminate paper, a synthetic paper, a plastic film paper, etc. A back coating layer may be disposed on the back surface of the substrate to improve a curl valance or a chemical resistance of the substrate. Also, a separate paper may be disposed on the back surface of the substrate through an adhesive layer, to form the recording medium in a label.

When a recording surface of the first recording medium is heated by a thermal head, etc., the liquid coloring composition contained in the first heat-sensitive microcapsules is vaporized, whereby the shell wall of each microcapsule is broken to fix its coloring matter to the substrate. The first recording medium will be described in detail below with reference to the attached drawing without intention of restricting the scope of the present invention.

FIG. 1 is a partial, schematic, cross-sectional view showing an embodiment according to the first recording medium of the present invention. The heat-sensitive recording medium 2 shown in FIG. 1 has a paper sheet 4 as the substrate, which is coated with a microcapsule layer 6. In the microcapsule layer 6 is uniformly distributed a plurality of the first heat-sensitive microcapsules 8. The heat-sensitive microcapsule 8 comprises a shell wall and a liquid coloring composition enclosed in the shell wall. In the first recording medium of the present invention, the liquid coloring composition generally produces a single color. The liquid coloring composition is the black coloring composition mentioned above in the case of the heat-sensitive recording medium 2 shown in FIG. 1. The shell wall of the heat-sensitive microcapsules 8 is generally made of a resin having the same color as the substrate, usually white. When the heat-sensitive microcapsule 8 is heated to a temperature equal to or higher than the boiling point of the black coloring composition, each of the heat-sensitive microcapsules 8 is broken by increased inner pressure to release the composition. Incidentally, although the microcapsule layer 6 is schematically shown as the microcapsules 8 are arranged on the paper sheet 4 one by one, so that the thickness of the microcapsule layer 6 is equal to a diameter of the microcapsule 8 in FIG. 1, actually, a plurality of the heat-sensitive microcapsules overlaps with each other in a thickness direction of the microcapsule layer 6, so that the thickness of the microcapsule layer 6 is larger than the diameter of the heat-sensitive microcapsule 8.

The microcapsule layer 6 may be formed by: preparing 3% aqueous solution of polyvinyl alcohol (polymerization degree: 2,000) as a binder; mixing and stirring 10 g of the heat-sensitive microcapsule 8 and a small amount of a dispersing agent (sodium dodecylbenzenesulfonate) with 100 g of the polyvinyl alcohol aqueous solution to obtain a suspension; spraying the suspension on the paper sheet 4 at a rate of 5 g/m$^2$ and drying the resultant sheet, for example.

In the case where the shell wall of the heat-sensitive microcapsule 8 is made of a material such as a amino resin not having sufficient adhesive properties to polyvinyl alcohol used as a binder, the heat-sensitive microcapsule 8 may be fixed into the microcapsule layer 6 by: mixing a predetermined amount, for example 10 g, of wax powder with the above-described suspension; spraying the resultant suspension on the paper sheet 4 at a rate of 5 g/m$^2$ and drying the resultant sheet; and heating the suspension to nearly a melting temperature of the wax powder to partially or entirely soften or melt the wax powder. If the heating temperature is lower than the melting temperature of the wax powder, particles of the wax powder are fused to each other to form a stonewall structure, the heat-sensitive microcapsules 8 being distributed therein. On the other hand, if the heating temperature is equal to or more than the melting temperature of the wax powder, the wax powder is completely melted, the heat-sensitive microcapsules 8 are being distributed in a solid wax binder layer. Generally, the wax powder also has the same color as the paper sheet 4.

The wax powder used for the microcapsule layer 6 has the melting temperature equal to or lower than 190° C., the primary azeotropic point of the black coloring composition. Such a wax powder may be "PPW-5" (polypropylene wax powder) or "CWP-3" (microcrystalline wax powder) manufactured by Seishin Enterprise Co., Ltd., etc. These wax powders are preferable from the viewpoint of thermal conductivity. The PPW-5 has an average diameter of 3 to 5 $\mu$m and a melting temperature of approximately 150° C. The CWP-3 has an average diameter of 3 to 5 $\mu$m and a melting temperature of approximately 108° C.

On the microcapsule layer 6 of the heat-sensitive recording medium 2 may be recorded a single color image by a conventional thermal printer. The thermal printer should has thermal heads with heating elements capable of heating the microcapsule layer 6 to a temperature equal to or higher than the primary azeotropic point of the black coloring composition (190° C.), for example 210° C., by electricity. The heating elements are selectively and locally heated by electrical energization corresponding to pixel signals, whereby black dots are appeared on the microcapsule layer 6 to form a single color image. Thus, when the microcapsule layer 6 is locally heated to 210° C. by the heating elements, the black coloring composition of the heat-sensitive microcapsules 8 in the heated region is heated to its primary azeotropic point or more, whereby the inner pressure of the heat-sensitive microcapsules 8 is rapidly increased to break the shell wall of the heat-sensitive microcapsules 8, so that the black coloring composition is released to produce black dots. The dot-size obtained by the conventional thermal head is generally approximately 50 to 100 $\mu$m.

Although the black coloring matter is carbon black in the heat-sensitive recording medium 2 shown in FIG. 1, the black coloring matter may be a leuco-dye that exhibits black by a chemical reaction with a color-developing agent, etc. Used as the leuco-dye for exhibiting black may be "Black 15" manufactured by Yamamoto Chemicals Inc., etc. In the case of using Black 15, Black 15 released from the heat-sensitive microcapsule 8 reacts with a color-developing agent such as colorless zinc salicylate, activated clay, etc. added to the microcapsule layer 6, thereby exhibiting black.

According to the heat-sensitive recording medium 2 shown in FIG. 1, various additives may be added to the microcapsule layer 6 to improve recording reliability and quality of the recorded image. Examples of the additives include anti-adhesion agents for preventing the dispersed coloring composition and fused wax from adhering to the heating element of the thermal head, loading materials for rapidly adsorbing the dispersed coloring composition, ultraviolet screening agents and oxidation inhibitors for preventing recorded images from discoloration, etc.

[B] Second Recording Medium

A second recording medium is a heat-sensitive recording medium comprising a substrate coated with a microcapsule layer including the second heat-sensitive microcapsule of the present invention mentioned above.

The second recording medium may be produced by dispersing the second heat-sensitive microcapsules in a binder, and by coating the substrate with the dispersion. The microcapsule layer may include the second heat-sensitive microcapsules, the color-developing agent, the color-producing agent, the binder, the loading material, other additives such as wax, antistatic agent, antifoaming agent, conductant agent, fluorescent dye, surface active agent, ultraviolet-absorbing agent, precursors thereof, etc. Examples of the binder, the loading material and the substrate used for the second recording medium are the same as those in the case of the first recording medium. When the second heat-sensitive microcapsules include the oxidative color-producing leuco-dye and the radical-forming, heat decomposition-type gas-developing agent, it is preferable that the color-developing agent is added to the binder around the heat-sensitive microcapsules to obtain a clear color.

When a recording surface of the second recording medium is heated by a thermal head, etc., the heat decomposition-type gas-developing agents contained in the second heat-sensitive microcapsules provide gas, whereby the shell wall of each heat-sensitive microcapsule is broken to fix the coloring composition to the substrate. The second recording medium of the present invention is described in more detail below by reference to Examples without intention of restricting the scope of the present invention.

(1) First Example of Second Recording Medium 60 g of p,p'-oxybis(benzenesulfonyl hydrazide) ("Celmike S" manufactured by Sankyo Chemical Co., Ltd., average diameter: approximately 1 $\mu$m) and 45 g of 3-(4-diethylamino-2-ethoxyphenyl)-3-(1-ethyl-2-methylindole-3-yl)-4-azaphthalide ("Blue-63" manufactured by Yamamoto Chemicals Inc.) were added to 910 g of diisopropyl naphthaline ("KMC-113" manufactured by Rutgers Kreha Solvents Gmbh), and uniformly dispersed therein to prepare an oil in which a gas-developing agent and a color-producing agent were dissolved.

The second heat-sensitive microcapsules were produced by in situ method comprising the steps of: emulsion-dispersing 150 g of the obtained oil in an aqueous solution; adding a prepolymer aqueous solution containing 100 g of melamine resin prepolymer, 50 g of urea resin prepolymer, 200 g of water to this emulsion-dispersed solution; and subjecting the prepolymers to polycondensation at 30 to 40° C. for 4 hours while maintaining pH of 3.6.

A dispersion having a composition shown in Table 2 was prepared, coated on a paper at a rate of 5 g (dry weight) of solid content per 1 m$^2$ of the paper by bar-coating method, and dried to obtain a heat-sensitive recording paper.

TABLE 2

| Composition of dispersion | |
|---|---|
| Heat-sensitive microcapsule | 20 weight parts |
| Binder (PVA, polymerization degree: 2,000) | 3 weight parts |
| Wax (carnauba wax powder, average diameter: 1 μm) | 10 weight parts |
| Loading material (silica powder, average diameter: 1 μm) | 5 weight parts |
| Dispersing agent (sodium dodecylbenzenesulfonate) | Suitable amount |

On the resultant heat-sensitive recording paper was recorded an image by a printer with a thermal line head having an exothermic electrical resistance of 2800 Ω and a resolution of 300 dpi under a pressure of 0.1 MPa applied for 2 msec. The shell wall of the heat-sensitive microcapsule was broken at approximately 10 V at a gas-developing temperature of OBSH, 150 to 155° C., to release the leuco-dye (Blue-63), and the released leuco-dye reacts with radical provided by p,p'-oxybis(benzenesulfonyl hydrazide) to exhibit a color.

Although the shell wall used in this example had a melting point of 300° C., the shell wall was broken at 150 to 155° C. As is clear from this, the heat-sensitive microcapsule is broken not by melt of the shell wall, but by the inner pressure increased by the gas-developing agent.

(2) Second Example of Second Recording Medium

A heat-sensitive recording paper was produced in the same manner as the first example except that the dispersion has a composition shown in Table 3.

TABLE 3

| Composition of dispersion | |
|---|---|
| Heat-sensitive microcapsule | 20 weight parts |
| Binder (PVA, polymerization degree: 2,000) | 3 weight parts |
| Wax (carnauba wax powder, average diameter: 1 μm) | 10 weight parts |
| Loading material (silica powder, average diameter: 1 μm) | 5 weight parts |
| Color-developing agent (zinc salicylate) | 5 weight parts |
| Dispersing agent (sodium dodecylbenzenesulfonate) | Suitable amount |

On the resultant heat-sensitive recording paper was recorded an image by a printer with a thermal line head having an exothermic electrical resistance of 2800 Ω and a resolution of 300 dpi under a pressure of 0.1 MPa applied for 2 msec. The shell wall of the heat-sensitive microcapsule was broken at approximately 10 V at a gas-developing temperature of OBSH, 150 to 155° C., to release the leuco-dye (Blue-63), and the released leuco-dye reacts with radical provided by p,p'-oxybis(benzenesulfonyl hydrazide) to exhibit a color. This heat-sensitive recording paper exhibited a deeper color as compared with that of example 1.

Although the shell wall used in this example had a melting point of 300° C., the shell wall was broken at 150 to 155° C. As is clear from this, the heat-sensitive microcapsule is broken not by melt of the shell wall, but by the inner pressure increased by the gas-developing agent.

(3) Third Example of Second Recording Medium 60 g of azobisisobutyronitrile (AIBN, Wako Pure Chemicals Industries, Ltd., average diameter: approximately 1.5 μm) and 45 g of 3,3-di(4-dimethylaminophenyl )-7-dimethylaminophthalide ("CVL" manufactured by Tokyo Kasei Kogyo Co., Ltd.) were added to 910 g of KMC-113, and uniformly dispersed therein to prepare oil in which a gas-developing agent and a color-producing agent were dissolved.

The second heat-sensitive microcapsules were produced by in situ method comprising the steps of: emulsion-dispersing 150 g of the obtained oil in an aqueous solution; adding a prepolymer aqueous solution containing 100 g of melamine resin prepolymer, 50 g of urea resin prepolymer, 200 g of water to this emulsion-dispersed solution; and subjecting the prepolymers to polycondensation at 30 to 40° C. for 4 hours while maintaining pH of 3.6.

A dispersion having a composition shown in Table 4 was prepared, coated on a paper at a rate of 5 g (dry weight) of solid content per 1 $m^2$ of the paper by bar-coating method, and dried to obtain a heat-sensitive recording paper.

TABLE 4

| Composition of dispersion | |
|---|---|
| Heat-sensitive microcapsule | 20 weight parts |
| Binder (PVA, polymerization degree: 2,000) | 3 weight parts |
| Wax (carnauba wax powder, average diameter: 1 μm) | 10 weight parts |
| Loading material (silica powder, average diameter: 1 μm) | 5 weight parts |
| Dispersing agent (sodium dodecylbenzenesulfonate) | Suitable amount |

On the resultant heat-sensitive recording paper was recorded an image by a printer with a thermal line head having an exothermic electrical resistance of 2800 Ω and a resolution of 300 dpi under a pressure of 0.1 MPa applied for 2 msec. The shell wall of the heat-sensitive microcapsule was broken at approximately 8 V at a gas-developing temperature of AIBN, approximately 100° C., to release the leuco-dye (CVL), and the released leuco-dye reacts with radical provided by AIBN to exhibit a color.

Although the shell wall used in this example had a melting point of 300° C., the shell wall was broken at approximately 100° C. As is clear from this, the heat-sensitive microcapsule is broken not by melt of the shell wall, but by the inner pressure increased by the gas-developing agent.

[C] Third Recording Medium

A third recording medium of the present invention is a pressure-sensitive, heat-sensitive recording medium comprising a substrate coated with a microcapsule layer. The microcapsule layer comprises upper, middle and lower portions, the lower portion being disposed on the substrate, the middle portion being disposed on the lower portion, the upper portion being disposed on the middle portion.

The upper portion includes a plurality of first pressure-sensitive microcapsules uniformly distributed in a first binder having a predetermined melting temperature, the first pressure-sensitive microcapsules each containing a first coloring composition. The middle portion includes a plurality of second pressure-sensitive microcapsules uniformly distributed in a second binder having a melting temperature higher than the melting temperature of the first binder, the second pressure-sensitive microcapsules each containing a second coloring composition. The lower portion includes a plurality of third pressure-sensitive microcapsules and a plurality of heat-sensitive microcapsules uniformly distributed in a third binder having a melting temperature higher than the melting temperature of the second binder, the third pressure-sensitive microcapsules each containing a third coloring composition, the heat-sensitive microcapsules each containing a fourth coloring composition.

The first pressure-sensitive microcapsule is broken under a first pressure at a first temperature higher than the melting temperature of the first binder, the second pressure-sensitive microcapsule is broken under a second pressure lower than the first pressure at a second temperature higher than the melting temperature of the second binder, the third pressure-sensitive microcapsule is broken under a third pressure lower than the second pressure at a third temperature higher than the melting temperature of the third binder, and the heat-sensitive microcapsule has such a temperature-breaking characteristic that the heat-sensitive microcapsule is broken by heating to a fourth temperature higher than the third temperature to release the fourth coloring composition. The third recording medium is capable of economically recording a color image with ease.

As the heat-sensitive microcapsule included in the lower portion, the above-mentioned first or second heat-sensitive microcapsule of the present invention may be preferably used. In the case of using the first heat-sensitive microcapsule of the present invention, the fourth coloring composition has a boiling point higher than the third temperature, and the first heat-sensitive microcapsule has such a temperature-breaking characteristic that the first heat-sensitive microcapsule is broken by heating to a temperature equal to or higher than the boiling point to release the fourth coloring composition. In the case of using the second heat-sensitive microcapsule of the present invention, the second heat-sensitive microcapsule comprises a heat decomposition-type gas-developing agent having a decomposition temperature higher than the third temperature, and the second heat-sensitive microcapsule has such a temperature-breaking characteristic that the second heat-sensitive microcapsule is broken by heating to a temperature equal to or higher than the decomposition temperature to release the fourth coloring composition.

According to the third recording medium of the present invention, it is preferred that an average diameter of the first pressure-sensitive microcapsules is smaller than an average diameter of the second pressure-sensitive microcapsules, and that the average diameter of the second pressure-sensitive microcapsules is smaller than an average diameter of the third pressure-sensitive microcapsules. Further, an average diameter of the heat-sensitive microcapsules is preferably smaller than the average diameters of the first, second and third pressure-sensitive microcapsules.

It is preferable that first spacer particles having an average diameter larger than the average diameter of the first pressure-sensitive microcapsules are uniformly distributed in the upper portion, and that second spacer particles having an average diameter larger than the average diameter of the second pressure-sensitive microcapsules are uniformly distributed in the middle portion. The first and second spacer particles are preferably made of an inorganic material or a high-melting point synthetic resin independently.

Each of the upper, middle and lower portions preferably has a stonewall structure where each of the first, second and third binders is composed of binder particles fused to each other. Each of the first, second and third coloring compositions may contain a vehicle and a coloring matter dispersed or dissolved in the vehicle. It is preferable that the coloring matter is a leuco-dye, each of the first, second and third binders comprising a color-developing agent for the leuco-dye. The first, second and third coloring compositions may exhibit three primary colors, in this case, the fourth coloring composition generally exhibits black.

The microcapsule layer may include the microcapsules, the color-developing agent, the color-producing agent, the binder, the loading material, other additives such as wax, antistatic agent, antifoaming agent, conductant agent, fluorescent dye, surface active agent, ultraviolet-absorbing agent, precursors thereof, etc. Examples of the binder, the loading material and the substrate used for the third recording medium are the same as those in the case of the first recording medium. An embodiment of the third recording medium according to the present invention, in which the first heat-sensitive microcapsule is used as the heat-sensitive microcapsule included in the lower portion, will be described in detail below with reference to the attached drawings without intention of restricting the scope of the present invention.

Figure 2:
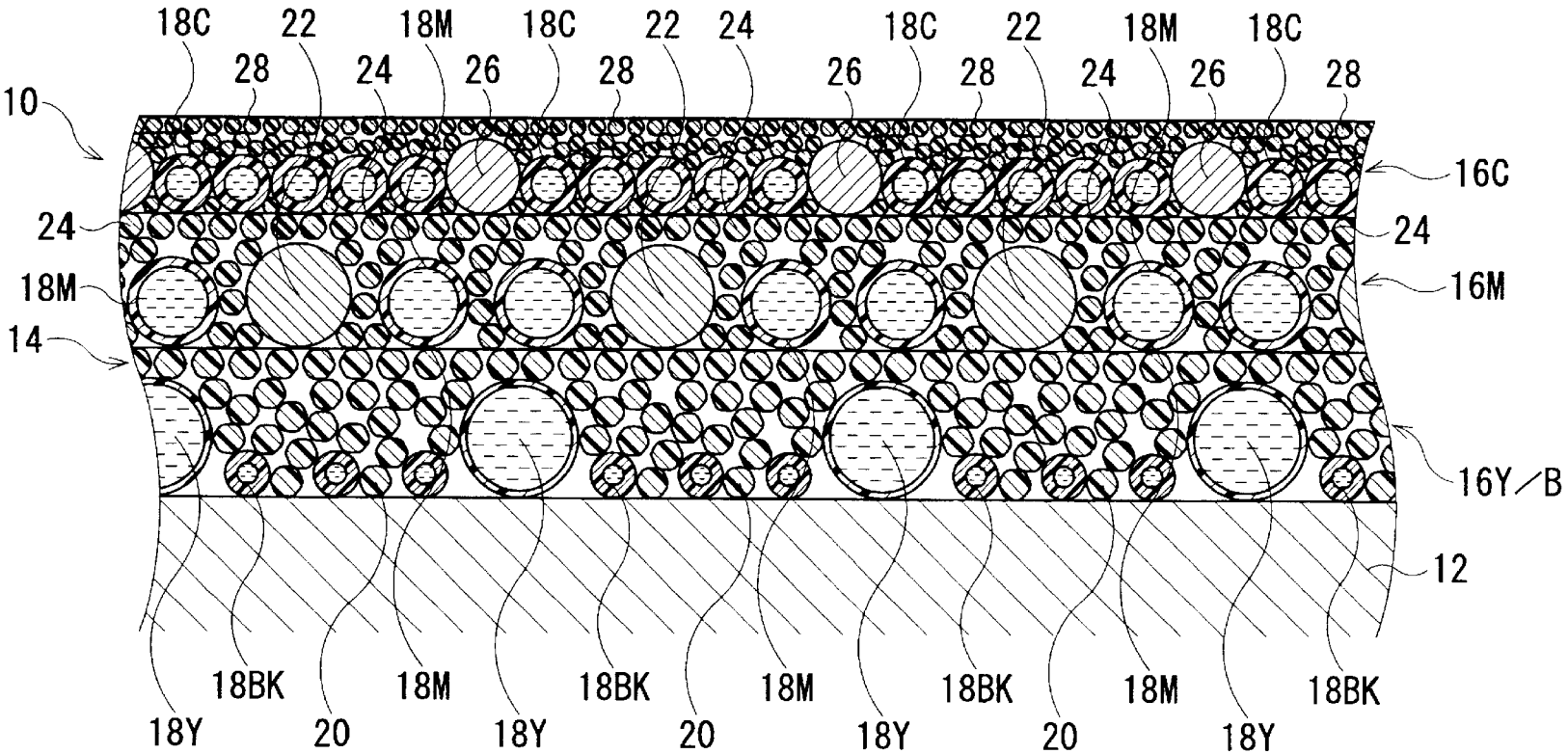
FIG. 2 is a partial, schematic, cross-sectional view showing an embodiment according to the third recording medium of the present invention.

FIG. 2 is a partial, schematic, cross-sectional view showing an embodiment according to the third recording medium of the present invention. The pressure-sensitive, heat-sensitive recording medium 10 shown in FIG. 2 has a paper sheet 12 as the substrate, which is coated with a microcapsule layer 14. The microcapsule layer 14 has a three-layer structure comprising a upper portion 16C for recording a cyan image, a middle portion 16M for recording a magenta image, and a lower portion 16Y/B for selectively recording an yellow or black image, thereby recording a full color image. The lower portion 16Y/B is disposed on the paper sheet 12, the middle portion 16M is disposed on the lower portion 16Y/B, and the upper portion 16C is disposed on the middle portion 16M.

Figure 3:
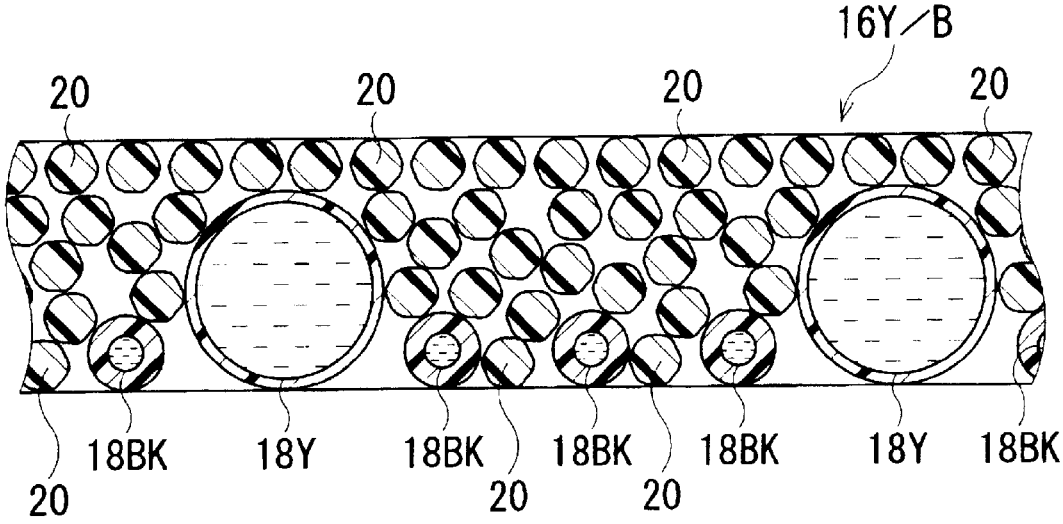
FIG. 3 is a partial, schematic, cross-sectional view showing a lower portion of the pressure-sensitive, heat-sensitive recording medium shown in FIG. 2.

FIG. 3 is a partial, schematic, cross-sectional view showing the lower portion 16Y/B of the pressure-sensitive, heat-sensitive recording medium 10 shown in FIG. 2. As shown in FIG. 3, the lower portion 16Y/B has a stonewall structure, where a plurality of third pressure-sensitive microcapsules 18Y each containing a yellow coloring composition and a plurality of heat-sensitive microcapsules 18BK each containing a black coloring composition are uniformly distributed in wax-type binder particles 20.

A shell wall of the pressure-sensitive microcapsule 18Y is made of a thermosetting amino resin having the same color as the paper sheet 12. The yellow coloring composition enclosed therein is prepared by mixing approximately 10 weight % of a yellow coloring matter with 100 weight % of a transparent oil. In this embodiment, "KMC-113" (2,7-diisopropyl naphthaline, boiling point: approximately 300° C.) manufactured by Rutgers Kreha Solvents Gmbh is used as the transparent oil, and "benzine yellow G" is used as the yellow coloring matter. The pressure-sensitive microcapsule 18Y may be also produced by the above-mentioned, conventional methods. The pressure-sensitive microcapsules 18Y have an average diameter of approximately 9 to 10 $\mu$m, and the shell wall has a thickness selected such that the pressure-sensitive microcapsule 18Y is broken under a pressure of 0.02 MPa or more involving a shearing force.

A shell wall of the heat-sensitive microcapsule 18BK is made of a thermosetting amino resin having the same color as the paper sheet 12. The black coloring composition enclosed therein is prepared by mixing approximately 10 weight % of a black coloring matter with 100 weight % of a transparent oil. In this embodiment, the transparent oil is such that is prepared by adding n-heptane to KMC-113 at a n-heptane/KMC-113 volume ratio of 10% to have a primary azeotropic point of approximately 190° C. Carbon black is used as the black coloring matter. The heat-sensitive microcapsule 18BK may be also produced by the above-mentioned, conventional methods. The heat-sensitive microcapsule 18BK have an average diameter of approximately 1 to 3 $\mu$m, and the shell wall has a thickness selected such that the heat-sensitive microcapsule 18BK is not broken even under a pressure of 3.0 MPa or more at a temperature lower than the primary azeotropic point of the black coloring composition (approximately 190° C.), and is broken by increased inner pressure thereof at a temperature equal to or higher than the primary azeotropic point to release the black coloring composition.

Used as the wax-type binder particle 20 may be a polypropylene wax such as "PPW-5" manufactured by Seishin Enterprise Co., Ltd., etc. The wax-type binder particles 20 have an average diameter of approximately 3 to 5 μm and a melting temperature of approximately 150° C. The polypropylene wax powder generally exhibits white color.

The lower portion 16Y/B having the stonewall structure may be obtained by a method comprising the steps of: preparing 3% aqueous solution of polyvinyl alcohol (polymerization degree: 2,000); mixing and stirring 10 g of PPW-5, 10 g of the pressure-sensitive microcapsule 18Y, 10 g of the heat-sensitive microcapsule 18BK and a small amount of a dispersing agent (sodium dodecylbenzenesulfonate) with 100 g of the aqueous solution to obtain a suspension; spraying the suspension on the paper sheet 12 at a rate of 5 g/m$^2$ and drying the resultant sheet; putting the dried sheet into an oven to heat to 145° C. lower than the melting temperature of PPW-5 (approximately 150° C.); and maintaining the temperature for approximately 15 minutes. By maintaining a predetermined temperature for a predetermined time, the binder particles 20 of PPW-5 are fused to each other to form the stonewall structure shown in FIG. 3. Such a heating treatment improves strength of the structure, being unnecessary in the case where the sufficient strength is obtained by the binder aqueous solution.

According to the above method, the binder particles 20 are not melted, whereby small spaces are formed between the binder particles and the pressure-sensitive microcapsules 18Y. Because the specific gravities of the pressure-sensitive microcapsule 18Y and the heat-sensitive microcapsule 18BK are larger than that of the binder particle 20, the microcapsules 18Y and 18BK is sank in the bottom of the lower portion 16Y/B and coated with the binder particles 20.

When the binder particles 20 are in a solid state, in other words, when the lower portion 16Y/B is heated to a temperature lower than the melting temperature of the binder particle 20, the breaking pressure of 0.02 MPa or more involving a shearing force is obstructed by the stonewall structure and cannot directly reach the microcapsules 18Y and 18BK, thereby breaking no microcapsules. When the lower portion 16Y/B is heated to a temperature, which is equal to or higher than the melting point of the binder particle 20 (150° C.) and is equal to or lower than the primary azeotropic point of the black coloring composition contained in the heat-sensitive microcapsule 18BK (190° C.), the binder particles 20 are softened or melted, whereby the pressure-sensitive microcapsule 18Y is broken by the breaking pressure of 0.02 MPa or more involving the shearing force to release the yellow coloring composition. The heat-sensitive microcapsule 18BK can resist the breaking pressure. On the other hand, when the lower portion 16Y/B is heated to a temperature higher than the melting temperature of the binder particle 20 and the primary azeotropic point of the black coloring composition, for example, 210° C., the heat-sensitive microcapsule 18BK is broken by its increased inner pressure to release the black coloring composition. In this time, the pressure-sensitive microcapsule 18Y is not broken if the applied pressure is less than 0.02 MPa, for example, 0.01 MPa.

Figure 4:
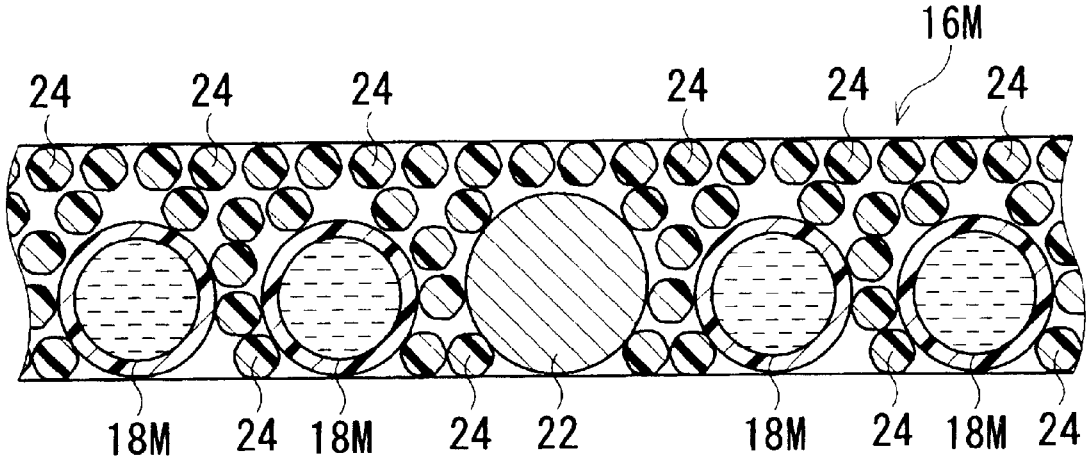
FIG. 4 is a partial, schematic, cross-sectional view showing a middle portion of the pressure-sensitive, heat-sensitive recording medium shown in FIG. 2.

FIG. 4 is a partial, schematic, cross-sectional view showing the middle portion 16M of the pressure-sensitive, heat-sensitive recording medium 10 shown in FIG. 2. As shown in FIG. 4, the middle portion 16M has a stonewall structure, where a plurality of second pressure-sensitive microcapsules 18M each containing a magenta coloring composition and a plurality of spacer particles 22 are uniformly distributed in a wax-type binder particles 24.

A shell wall of the pressure-sensitive microcapsule 18M is made of a thermosetting amino resin having the same color as the paper sheet 12 as well as the microcapsules 18Y and 18BK. The magenta coloring composition enclosed therein is prepared by mixing approximately 10 weight % of a magenta coloring matter with 100 weight % of a transparent oil. In this embodiment, KMC-113 is used as the transparent oil, and "Rhodamine lake T" is used as the magenta coloring matter. The pressure-sensitive microcapsule 18M may be also produced by the above-mentioned, conventional methods. The pressure-sensitive microcapsules 18M have an average diameter of approximately 6 to 7 μm, and the shell wall has a thickness selected such that the pressure-sensitive microcapsule 18M is broken under a pressure of 0.2 MPa or more involving a shearing force. The spacer particles 22 are made of hydroxyapatite in this embodiment, and have an average diameter of approximately 8 to 9 μm larger than that of the pressure-sensitive microcapsule 18M.

Used as the wax-type binder particle 24 may be a microcrystalline wax such as "CWP-3" manufactured by Seishin Enterprise Co., Ltd., etc. The wax-type binder particles 24 have an average diameter of approximately 3 to 5 μm and a melting temperature of approximately 108° C. The microcrystalline wax powder generally exhibits white color.

The middle portion 16M having the stonewall structure may be obtained by a method comprising the steps of: preparing 3% aqueous solution of polyvinyl alcohol (polymerization degree: 2,000); mixing and stirring the spacer particles 22, 10 g of CWP-3, 10 g of the pressure-sensitive microcapsules 18M and a small amount of a dispersing agent (sodium dodecylbenzenesulfonate) with 100 g of the aqueous solution to obtain a suspension; spraying the suspension on the lower portion 16Y/B at a rate of 2 to 4 g/m$^2$ and air-drying the resultant sheet; putting the dried sheet into an oven to heat to 103° C. lower than the melting temperature of CWP-3 (approximately 108° C.); and maintaining the temperature for approximately 15 minutes. By maintaining a predetermined temperature for a predetermined time, the binder particles 24 of CWP-3 are fused to each other to form the stonewall structure shown in FIG. 4. Such a heating treatment improves strength of the structure, being unnecessary in the case where the sufficient strength is obtained by the binder aqueous solution.

When the binder particles 24 are in a solid state, in other words, when the middle portion 16M is heated to a temperature lower than the melting temperature of the binder particle 24, the breaking pressure of 0.2 MPa or more involving a shearing force is obstructed by the stonewall structure and cannot directly reach the pressure-sensitive microcapsule 18M, thereby breaking no microcapsule. When the middle portion 16M is heated to a temperature, which is equal to or higher than the melting point of the binder particle 24 (108° C.), the binder particles 24 are softened or melted, whereby the pressure-sensitive microcapsule 18M is broken by the breaking pressure of 0.2 MPa or more involving the shearing force. Incidentally, functions of the spacer particle 22 included in the middle portion 16M will be described in detail below.

Figure 5:
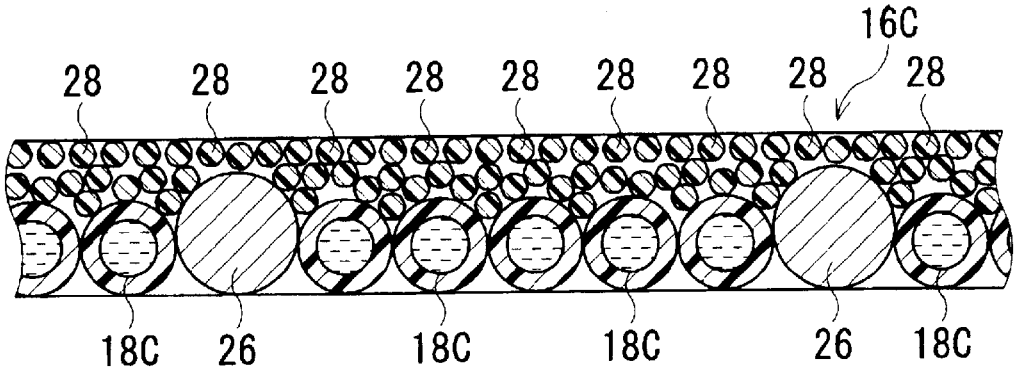
FIG. 5 is a partial, schematic, cross-sectional view showing an upper portion of the pressure-sensitive, heat-sensitive recording medium shown in FIG. 2.

FIG. 5 is a partial, schematic, cross-sectional view showing the upper portion 16C of the pressure-sensitive, heat-sensitive recording medium 10 shown in FIG. 2. As shown in FIG. 5, the upper portion 16C has a stonewall structure, where a plurality of first pressure-sensitive microcapsules 18C each containing a cyan coloring composition and a plurality of spacer particles 26 are uniformly distributed in a wax-type binder particles 28.

A shell wall of the pressure-sensitive microcapsule 18C is made of a thermosetting amino resin having the same color as the paper sheet 12 as well as the microcapsules 18Y, 18BK and 18M. The cyan coloring composition enclosed therein is prepared by mixing approximately 10 weight % of a cyan coloring matter with 100 weight % of a transparent oil. In this embodiment, KMC-113 is used as the transparent oil, and "Phthalocyanine blue" is used as the cyan coloring matter. The pressure-sensitive microcapsule 18C may be also produced by the above-mentioned, conventional methods. The pressure-sensitive microcapsules 18C have an average diameter of approximately 3 to 4 μm, and the shell wall has a thickness selected such that the pressure-sensitive microcapsule 18C is broken under a pressure of 2.0 MPa or more involving a shearing force. The spacer particles 26 are made of hydroxyapatite in this embodiment, and have an average diameter of approximately 5 to 9 μm larger than that of the pressure-sensitive microcapsule 18C.

Used as the wax-type binder particle 28 may be a paraffin wax having a melting temperature of approximately 73° C. Such a wax-type binder particles 28 may be obtained by grinding a paraffin wax into a particles with an average diameter of approximately 1 to 3 μm by a jet mill. The paraffin wax powder generally exhibits white color.

The upper portion 16C having the stonewall structure may be obtained by a method comprising the steps of: preparing 3% aqueous solution of polyvinyl alcohol (polymerization degree: 2,000); mixing and stirring 5 g of the spacer particles 26, 10 g of the paraffin wax particles (binder particles 28), 10 g of the pressure-sensitive microcapsule 18C and a small amount of a dispersing agent (sodium dodecylbenzenesulfonate) with 100 g of the aqueous solution to obtain a suspension; spraying the suspension on the middle portion 16M at a rate of 1 to 3 g/m$^2$ and air-drying the resultant sheet; putting the dried sheet into an oven to heat to 68° C. lower than the melting temperature of the paraffin wax particle (approximately 73° C.); and maintaining the temperature for approximately 15 minutes. By maintaining a predetermined temperature for a predetermined time, the binder particles 28 of the paraffin wax are fused to each other to form the stonewall structure shown in FIG. 5. Such a heating treatment improves strength of the structure, being unnecessary in the case where the sufficient strength is obtained by the binder aqueous solution.

When the binder particles 28 are in a solid state, in other words, when the upper portion 16C is heated to a temperature lower than the melting temperature of the binder particle 28, the breaking pressure of 2.0 MPa or more involving a shearing force is obstructed by the stonewall structure and cannot directly reach the pressure-sensitive microcapsule 18C, thereby breaking no microcapsule. When the upper portion 16C is heated to a temperature, which is equal to or higher than the melting point of the binder particle 28 (73° C.), the binder particles 28 are softened or melted, whereby the pressure-sensitive microcapsule 18C is broken by the breaking pressure of 2.0 MPa or more involving the shearing force. Incidentally, functions of the spacer particle 26 included in the upper portion 16C will be described in detail below.

Figure 6:
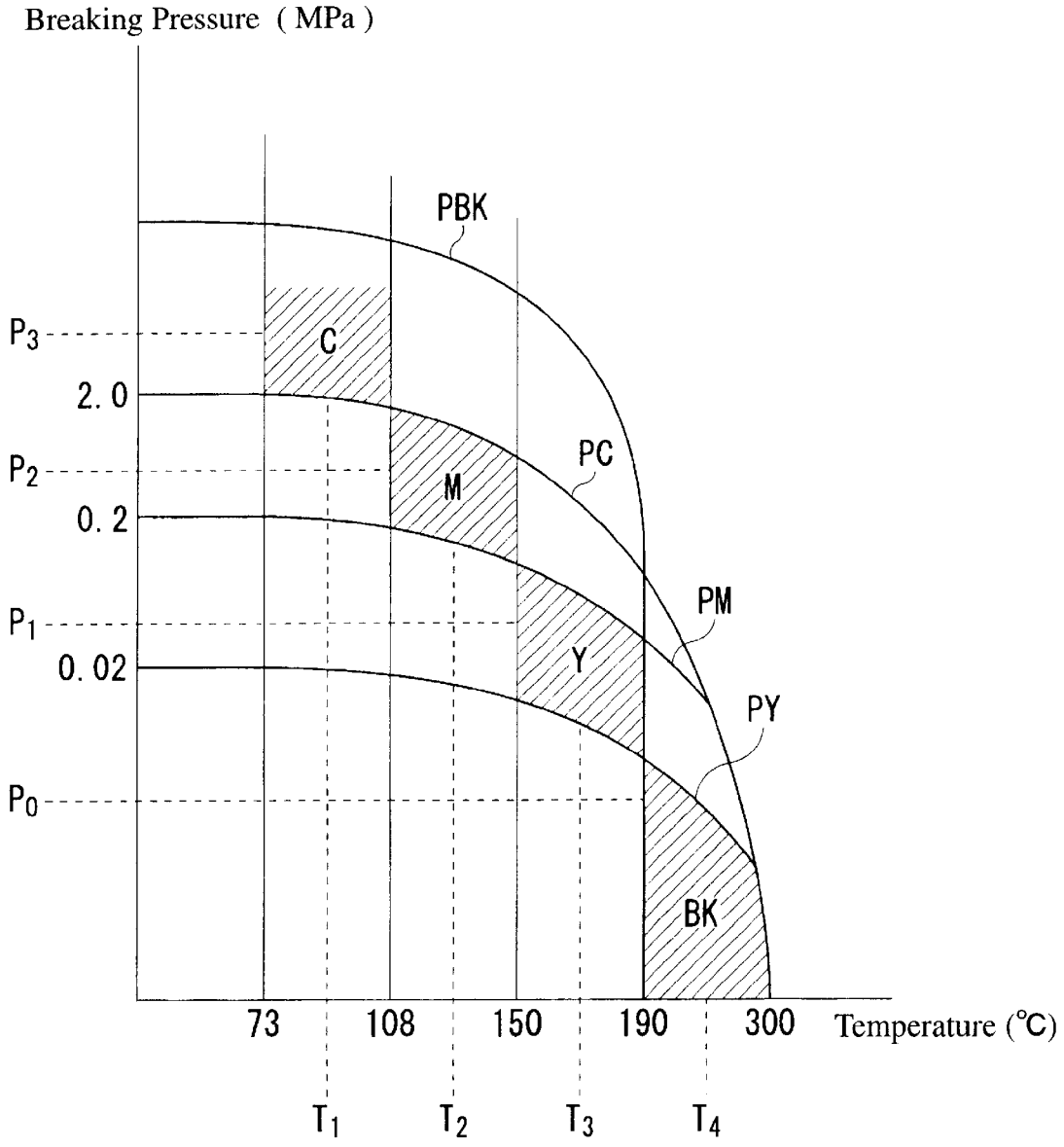
FIG. 6 is a graph showing a relation between temperature and breaking pressure according to four microcapsules included in the microcapsule layer of the pressure-sensitive, heat-sensitive recording medium shown in FIG. 2.

In short, the pressure-sensitive microcapsules 18C, 18M and 18Y, and the heat-sensitive microcapsule 18BK each contained in the portion 16C, 16M or 16Y/B of the pressure-sensitive, heat-sensitive recording medium 10 exhibit temperature/pressure-breaking characteristics shown in a graph of FIG. 6.

As shown in FIG. 6, a cyan-exhibiting region C is provided by a temperature/breaking pressure curve PC according to the shell wall of the pressure-sensitive microcapsule 18C contained in the upper portion 16C, the melting temperature of the binder particle 28 contained in the upper portion 16C (73° C.), and the melting temperature of the binder particle 24 contained in the middle portion 16M (108° C.). If a temperature $T_1$ and a pressure $P_3$ in the cyan exhibiting region C are applied to the microcapsule layer 14 of the pressure-sensitive, heat-sensitive recording medium 10, only the pressure-sensitive microcapsule 18C is broken to release the cyan coloring composition.

Also, as shown in FIG. 6, a magenta-exhibiting region M is provided by the temperature/breaking pressure curve PC, a temperature/breaking pressure curve PM according to the shell wall of the pressure-sensitive microcapsule 18M contained in the middle portion 16M, the melting temperature of the binder particle 24 contained in the middle portion 16M (108° C.), and the melting temperature of the binder particle 20 contained in the lower portion 16Y/B (150° C.). If a temperature $T_2$ and a pressure $P_2$ in the magenta-exhibiting region M are applied to the microcapsule layer 14 of the pressure-sensitive, heat-sensitive recording medium 10, only the pressure-sensitive microcapsule 18M is broken to release the magenta coloring composition.

Further, as shown in FIG. 6, an yellow exhibiting region Y is provided by the temperature/breaking pressure curve PM, a temperature/breaking pressure curve PY according to the shell wall of the pressure-sensitive microcapsule 18Y contained in the lower portion 16Y/B, the melting temperature of the binder particle 20 contained in the lower portion 16Y/B (150° C.), and the primary azeotropic point of the black coloring composition contained in the heat-sensitive microcapsule 18BK contained in the lower portion 16Y/B (190° C.). If a temperature $T_3$ and a pressure $P_1$ in the yellow exhibiting region Y are applied to the microcapsule layer 14 of the pressure-sensitive, heat-sensitive recording medium 10, only the pressure-sensitive microcapsule 18Y is broken to release the yellow coloring composition.

Furthermore, as shown in FIG. 6, a black-exhibiting region BK is provided by the temperature/breaking pressure curve PY and the primary azeotropic point of the black coloring composition contained in the heat-sensitive microcapsule 18BK (190° C.). If a temperature $T_4$ and a pressure $P_0$ in the black-exhibiting region BK are applied to the microcapsule layer 14 of the pressure-sensitive, heat-sensitive recording medium 10, only the heat-sensitive microcapsule 18BK is broken to release the black coloring composition. In other words, the heat-sensitive microcapsule 18BK is broken by the increased inner pressure at a temperature equal to or higher than the primary azeotropic point of the black coloring composition, thereby discharging the black coloring composition.

As is clear from a temperature/breaking pressure curve PBK according to the shell wall of the heat-sensitive microcapsule 18BK shown in FIG. 6, the thickness of the shell wall of the heat-sensitive microcapsule 18BK is selected such that the heat-sensitive microcapsule 18BK is not broken at least under a pressure equal to or more than each of $P_3$, $P_2$ and $P_1$ at each of the temperatures $T_1$, $T_2$ and $T_3$. The heat-sensitive microcapsule 18BK is generally not broken without heating to a temperature equal to or higher than the primary azeotropic point of the black coloring composition.

Thus, the pressure-sensitive microcapsules 18C, 18M and 18Y, and the heat-sensitive microcapsule 18BK can be selectively broken by selecting the temperature and pressure applied to the microcapsule layer 14 of the pressure-sensitive, heat-sensitive recording medium 10. In this embodiment, the temperatures $T_1$, $T_2$, $T_3$ and $T_4$ are 90° C., 130° C., 170° C. and 210° C., and the pressures $P_0$, $P_1$, $P_2$ and P3 are 0.01 MPa, 0.1 MPa, 1.0 MPa and 3.0 MPa, respectively.

Figure 7:
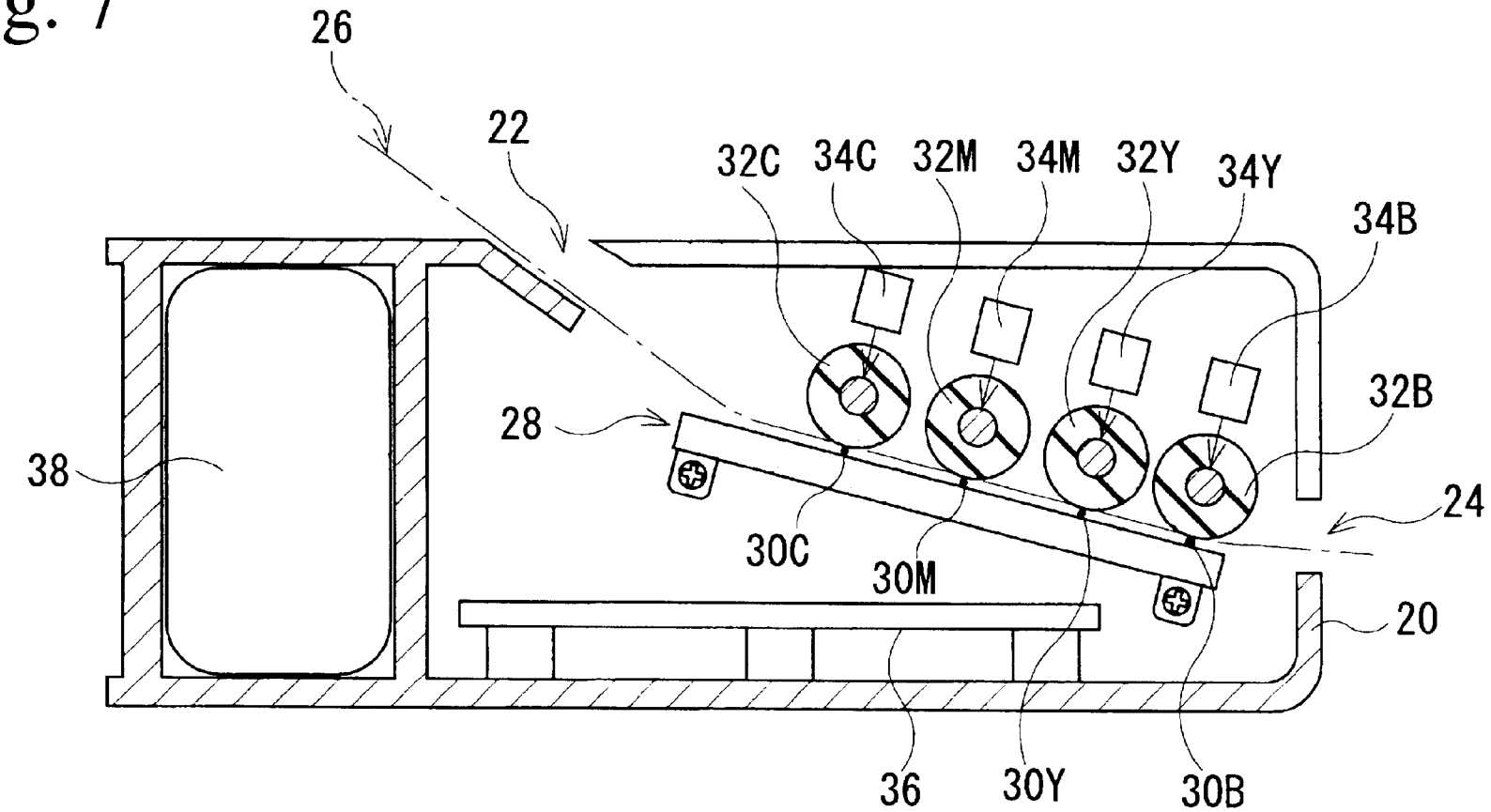
FIG. 7 is a schematic, cross-sectional view showing an example of an image-recording device for recording a color image on the pressure-sensitive, heat-sensitive recording medium shown in FIG. 2.

FIG. 7 is a schematic, cross-sectional view showing an example of an image-recording device for recording a color image on the pressure-sensitive, heat-sensitive recording medium 10 shown in FIG. 2. This pressure-sensitive, heat-sensitive image-recording device can be used as a color line printer.

As shown in FIG. 7, the pressure-sensitive, heat-sensitive image-recording device comprises a housing 20 having a rectangular solid shape. On an upper wall of the housing 20 is provided an orifice 22 for introducing the pressure-sensitive, heat-sensitive recording medium 10, and on one side wall thereof is provided a release orifice 24 for discharging the pressure-sensitive, heat-sensitive recording medium 10. A conveyer pathway 26 of the recording medium 10 is illustrated by an alternate long and short dash line in FIG. 7.

In the housing 20, a thermal head supporting body 28 is provided to partially determine the conveyer pathway 26. A first thermal head 30C, a second thermal head 30M, a third thermal head 30Y and a fourth thermal head 30B are provided on the thermal head-supporting body 28 in this order from the orifice 22 to the release orifice 24. Each of the thermal heads is in a direction crossing the conveyer pathway 26, and a plurality of electric resistance units, heating elements, is aligned in the direction. Each of the first, second, third and fourth thermal heads 30C, 30M, 30Y and 30B has a predetermined number (n) of heating elements.

Figure 8:
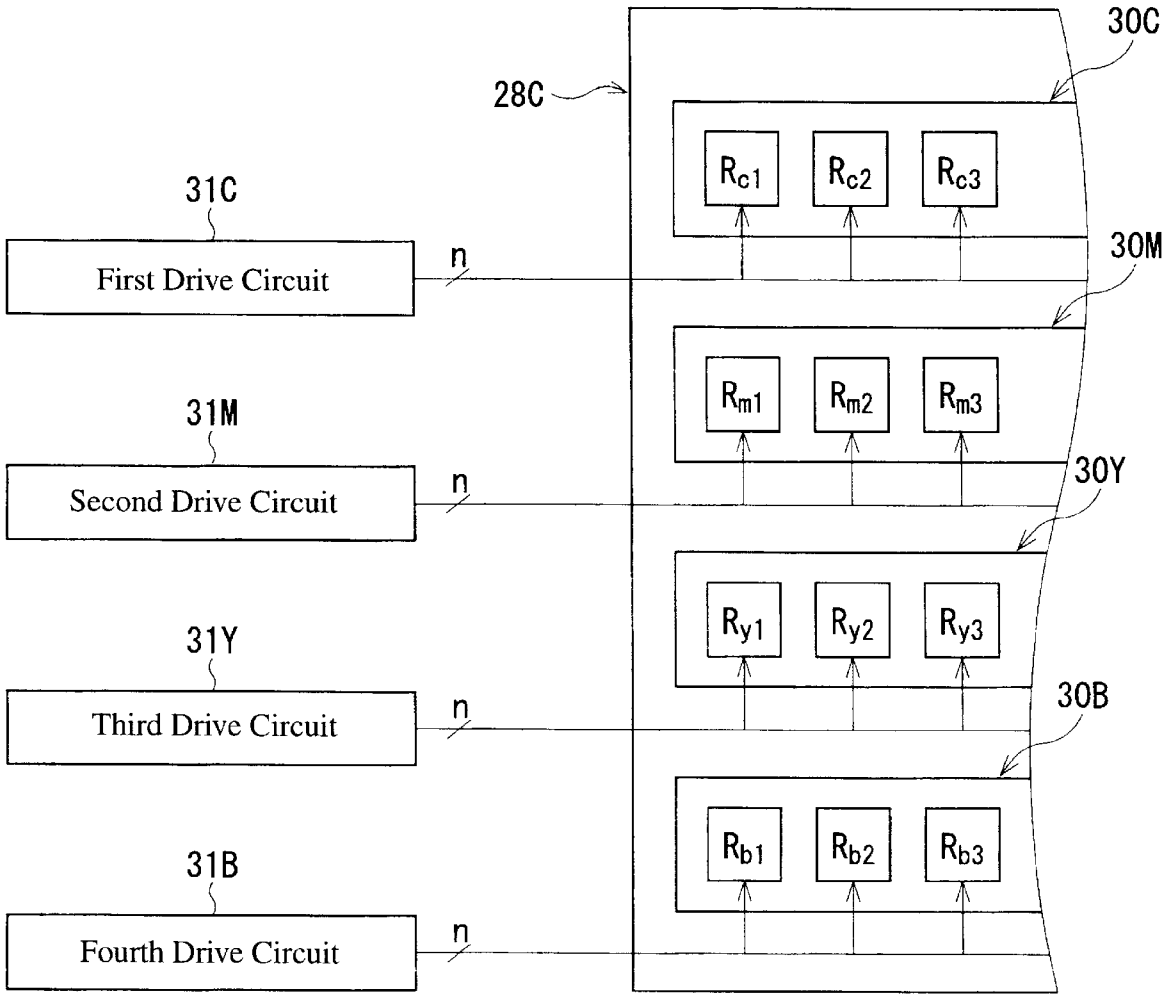
FIG. 8 is a block diagram showing a control system of first, second, third and fourth thermal heads of the image-recording device shown in FIG. 7.

FIG. 8 is a block diagram showing a control system of the first, second, third and fourth thermal heads of the image-recording device shown in FIG. 7. The first thermal head 30C has a predetermined number (n) of heating elements $R_{c1}$, $R_{c2}$, $R_{c3}$, . . . , $R_{cn}$, the second thermal head 30M has a predetermined number (n) of heating elements $R_{m1}$, $R_{m2}$, $R_{m3}$, . . . , $R_{mn}$, the third thermal head 30Y has a predetermined number (n) of heating elements $R_{y1}$, $R_{y2}$, $R_{y3}$, . . . , $R_{yn}$, and the fourth thermal head 30B has a predetermined number (n) of heating elements $R_{b1}$, $R_{b2}$, $R_{b3}$, . . . , $R_{bn}$. The heating elements are arranged in a matrix of four row and n column, and four heating elements in a column, for example, $R_{c2}$, $R_{m2}$, $R_{y2}$ and $R_{b2}$, are aligned in conveyer pathway direction.

The heating elements $R_{c1}$, $R_{c2}$, $R_{c3}$, . . . , $R_{cn}$ of the first thermal head 30C are connected to a first thermal head drive circuit 31C. The heating elements $R_{c1}$, $R_{c2}$, $R_{c3}$, . . . , $R_{cn}$ are electrically energized and heated by the first thermal head drive circuit 31C in accordance with cyan pixel signals of a line, wherein the heating temperature $T_1$ is between the melting temperature of the binder particle 28 contained in the upper portion 16C (73° C.) and the melting temperature of the binder particle 24 contained in the middle portion 16M (108° C.), for example, 90° C.

The heating elements $R_{m1}$, $R_{m2}$, $R_{m3}$, . . . , $R_{mn}$ of the second thermal head 30M are connected to a second thermal head drive circuit 31M. The heating elements $R_{m1}$, $R_{m2}$, $R_{m3}$, . . . , $R_{mn}$ are electrically energized and heated by the second thermal head drive circuit 31M in accordance with magenta pixel signals of a line, wherein the heating temperature $T_2$ is between the melting temperature of the binder particle 24 contained in the middle portion 16M (108° C.) and the melting temperature of the binder particle 20 contained in the lower portion 16Y/B (150° C.), for example, 130° C.

The heating elements $R_{y1}$, $R_{y2}$, $R_{y3}$, . . . , $R_{yn}$ of the third thermal head 30Y are connected to a third thermal head drive circuit 31Y. The heating elements $R_{y1}$, $R_{y2}$, $R_{y3}$, . . . , $R_{yn}$, are electrically energized and heated by the third thermal head drive circuit 31Y in accordance with yellow pixel signals of a line, wherein the heating temperature $T_3$ is between the melting temperature of the binder particle 20 contained in the lower portion 16Y/B (150° C.) and the primary azeotropic point of the black coloring composition contained in the heat-sensitive microcapsule 18BK (190° C.), for example, 170° C.

The heating elements $R_{b1}$, $R_{b2}$, $R_{b3}$, . . . , $R_{bn}$ of the fourth thermal head 30B are connected to a fourth thermal head drive circuit 31B. The heating elements $R_{b1}$, $R_{b2}$, $R_{b3}$, . . . , $R_{bn}$ are electrically energized and heated by the fourth thermal head drive circuit 31B in accordance with black pixel signals of a line, wherein the heating temperature $T_4$ is higher than the primary azeotropic point of the black coloring composition contained in the heat-sensitive microcapsule 18BK (190° C.), for example, 210° C.

As shown in FIG. 7, a first roller platen 32C combined with a first pressure-applying spring 34C is applied to the first thermal head 30C. The first pressure-applying spring 34C applies a pressure $P_3$ (3.0 MPa) more than 2.0 MPa to the first roller platen 32C, whereby the first roller platen 32C comes into contact with the first thermal head 30C with the pressure $P_3$.

A second roller platen 32M combined with a second pressure-applying spring 34M is applied to the second thermal head 30M. The second pressure-applying spring 34M applies a pressure $P_2$ (1.0 MPa) of 0.2 to 2.0 MPa to the second roller platen 32M, whereby the second roller platen 32M comes into contact with the second thermal head 30M with the pressure $P_2$.

A third roller platen 32Y combined with a third pressure-applying spring 34Y is applied to the third thermal head 30Y. The third pressure-applying spring 34Y applies a pressure $P_1$ (0.1 MPa) of 0.02 to 0.2 MPa to the third roller platen 32Y, whereby the third roller platen 32Y comes into contact with the third thermal head 30Y with the pressure $P_1$.

A fourth roller platen 32B combined with a fourth pressure-applying spring 34B is applied to the fourth thermal head 30B. The fourth pressure-applying spring 34B applies a pressure $P_0$ (0.01 MPa) less than 0.02 MPa to the fourth roller platen 32B, whereby the fourth roller platen 32B comes into contact with the fourth thermal head 30B with the pressure $P_0$.

Each heating element described above has a sizing corresponding to a pixel (dot) of a color image to be recorded on the microcapsule layer 14. The dots obtained by the heating elements are approximately 50 to 100 $\mu$m in size in this embodiment.

The device shown in FIG. 7 has a circuit board 36 for controlling the first, second, third and fourth thermal heads 30C, 30M, 30Y and 30B, etc., and a power source 38. The heating elements of the thermal heads 30C, 30M, 30Y and 30B, the circuit board 36, etc. are electrically supplied by the power source 38.

The pressure-sensitive, heat-sensitive recording medium 10 is introduced through the orifice 22 such that the microcapsule layer 14 thereof comes into contact with the heating elements ($R_{c1}$, . . . , $R_{cn}$; $R_{m1}$, . . . , $R_{mn}$; $R_{y1}$, . . . , $R_{yn}$; $R_{b1}$, . . . , $R_{bn}$) of the first, second, third and fourth thermal heads 30C, 30M, 30Y and 30B.

Next, process for producing a full color image on the pressure-sensitive, heat-sensitive recording medium 10 by the pressure-sensitive, heat-sensitive image-recording device shown in FIG. 7 is described below.

When the pressure-sensitive, heat-sensitive recording medium 10 is conveyed between the first thermal head 30C and the first roller platen 32C, to the microcapsule layer 14 thereof is applied the breaking pressure $P_3$ of 3.0 MPa involving a shearing force by the first pressure-applying spring 34C through the heating elements $R_{c1}$, $R_{c2}$, $R_{c3}$, . . . , $R_{cn}$ of the first thermal head 30C. The breaking pressure $P_3$ is obstructed by the stonewall structure of the binder particles 20, 24 and 28 and cannot directly reach the pressure-sensitive microcapsules 18C, 18M and 18Y, and the heat-sensitive microcapsule 18BK.

Figure 9:
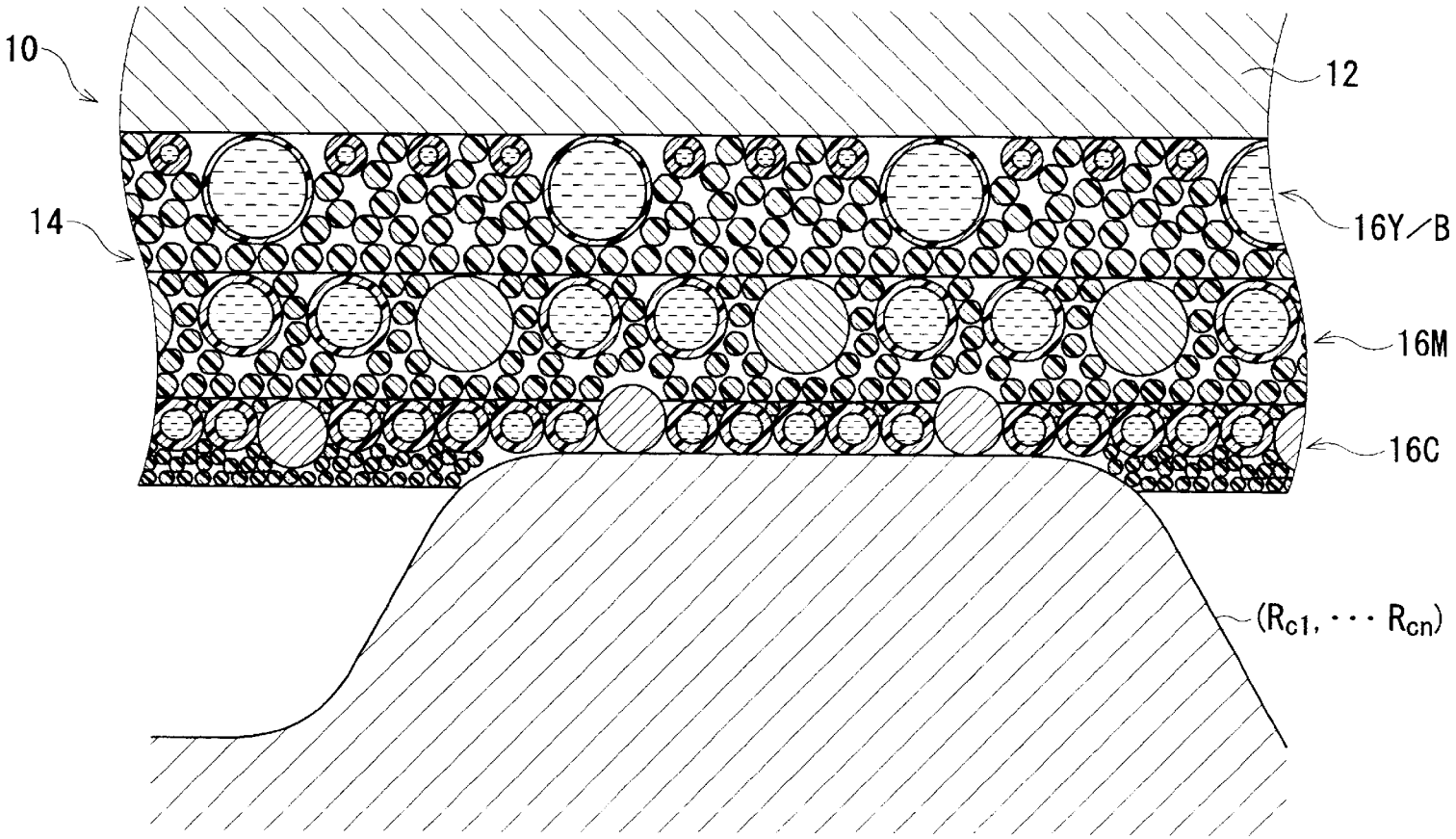
FIG. 9 is a partial, schematic, cross-sectional view showing a process for providing cyan dot on the upper portion of the pressure-sensitive, heat-sensitive recording medium shown in FIG. 2 by a heating element of the first thermal head of the image-recording device shown in FIG. 7.

If any of the heating elements $Rc_1$, $R_{c2}$, $R_{c3}$, . . . , $R_{cn}$ of the first thermal head 30C is electrically energized, the energized heating elements are heated to a temperature $T_1$ (90° C.) higher than the melting temperature of the binder particle 28 contained in the upper portion 16C (73° C.). The binder particles 28 corresponding to the energized heating elements are softened or melted, whereby the stonewall structure of the upper portion 16C is partially broken. The energized heating elements penetrate into the upper portion 16C, and apply the pressure $P_3$ (3.0 MPa) involving a shearing force to the pressure-sensitive microcapsules 18C as shown in FIG. 9. Thus, the pressure-applied pressure-sensitive microcapsules 18C are broken to release the cyan coloring composition, thereby producing cyan dots. Incidentally, melted waxes are provided from the binder particles 28 to penetrate into the stonewall structure of the upper and middle portions 16C and 16M (not shown in FIG. 9).

When the pressure-sensitive, heat-sensitive recording medium 10 is conveyed between the second thermal head 30M and the second roller platen 32M, to the microcapsule layer 14 thereof is applied the breaking pressure $P_2$ of 1.0 MPa involving a shearing force by the second pressure-applying spring 34M through the heating elements $R_{m1}$, $R_{m2}$, $R_{m3}$, . . . , $R_{mn}$ of the second thermal head 30M. The breaking pressure $P_2$ is obstructed by the stonewall structure of the binder particles 20, 24 and 28 and cannot directly reach the pressure-sensitive microcapsules 18C, 18M and 18Y, and the heat-sensitive microcapsule 18BK.

Figure 10:
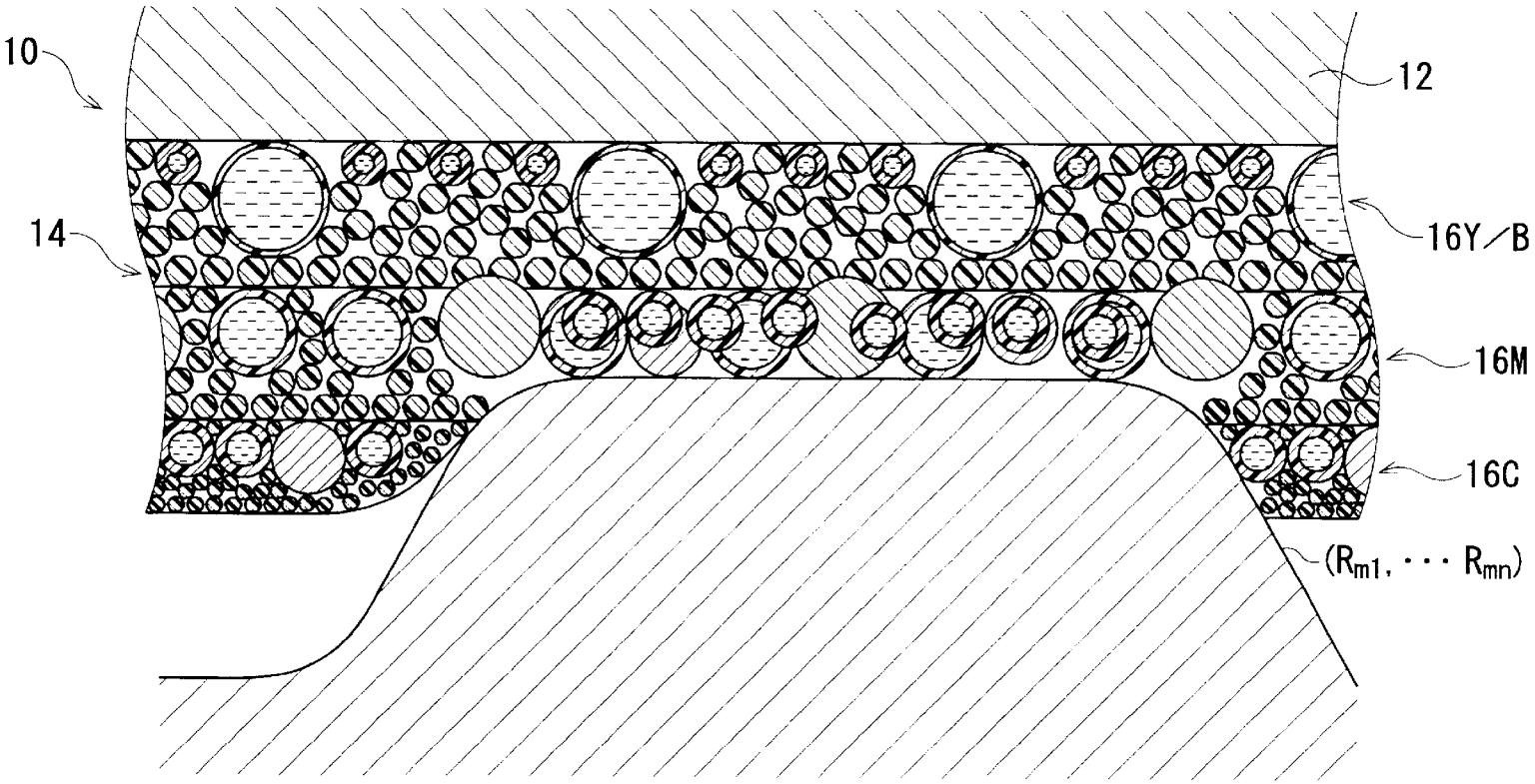
FIG. 10 is a partial, schematic, cross-sectional view showing a process for providing magenta dot on the middle portion of the pressure-sensitive, heat-sensitive recording medium shown in FIG. 2 by a heating element of the second thermal head of the image-recording device shown in FIG. 7.

If any of the heating elements $R_{m1}$, $R_{m2}$, $R_{m3}$, . . . , $R_{mn}$ of the second thermal head 30M is electrically energized, the energized heating elements are heated to a temperature $T_2$ (130° C.) higher than the melting temperatures of the binder particles 28 and 24 each contained in the upper or middle portion 16C or 16M (73° C. and 108° C.). The binder particles 28 and 24 corresponding to the energized heating elements are softened or melted, whereby the stonewall structure of the upper and middle portions 16C and 16M is partially broken. The energized heating elements penetrate into the upper and middle portion 16C and 16M, and apply the pressure $P_2$ (1.0 MPa) involving a shearing force to the pressure-sensitive microcapsules 18C and 18M as shown in FIG. 10. Although the pressure-sensitive microcapsules 18C are not broken by the breaking pressure $P_2$, the pressure-applied pressure-sensitive microcapsules 18M are broken to release the magenta coloring composition, thereby producing magenta dots. Incidentally, melted waxes are provided from the binder particles 28 and 24 to penetrate into the stonewall structure of the upper, middle and lower portions 16C, 16M and 16Y/B (not shown in FIG. 10).

When the pressure-sensitive, heat-sensitive recording medium 10 is conveyed between the third thermal head 30Y and the third roller platen 32Y, to the microcapsule layer 14 thereof is applied the breaking pressure $P_1$ of 0.1 MPa involving a shearing force by the third pressure-applying spring 34Y through the heating elements $R_{y1}$, $R_{y2}$, $R_{y3}$, . . . , $R_{yn}$ of the third thermal head 30Y. The breaking pressure $P_1$ is obstructed by the stonewall structure of the binder particles 20, 24 and 28 and cannot directly reach the pressure-sensitive microcapsules 18C, 18M and 18Y, and the heat-sensitive microcapsule 18BK.

Figure 11:
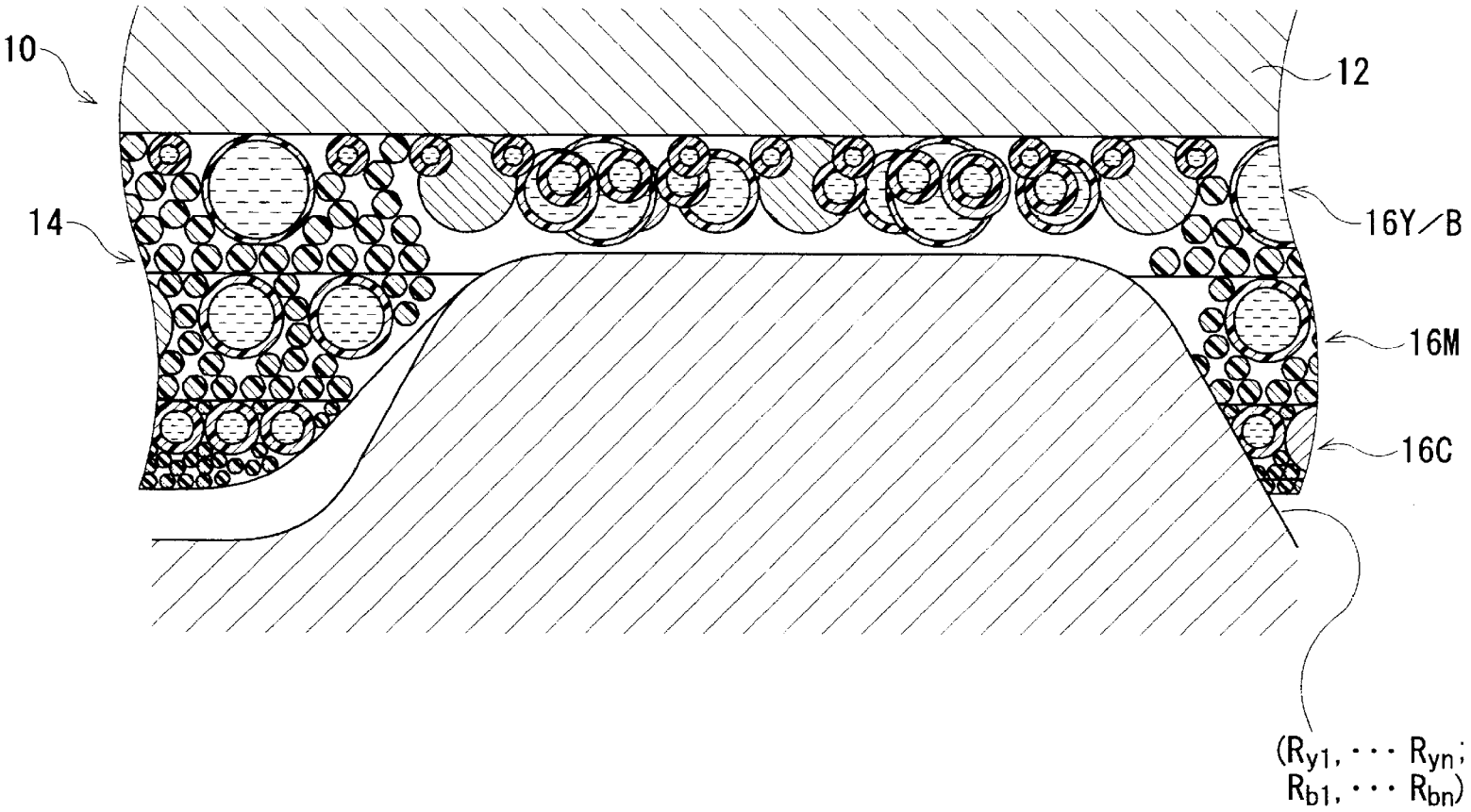
FIG. 11 is a partial, schematic, cross-sectional view showing a process for providing yellow or black dot on the lower portion of the pressure-sensitive, heat-sensitive recording medium shown in FIG. 2 by a heating element of the third or fourth thermal head of the image-recording device shown in FIG. 7.

If any of the heating elements $R_{y1}$, $R_{y2}$, $R_{y3}$, . . . , $R_{yn}$ of the third thermal head 30Y is electrically energized, the energized heating elements are heated to a temperature $T_3$ (170° C.) higher than the melting temperatures of the binder particles 28, 24 and 20 each contained in the upper, middle or lower portion 16C, 16M or 16Y/B (73° C., 108° C. and 150° C.). The binder particles 28, 24 and 20 corresponding to the energized heating elements are softened or melted, whereby the stonewall structure of the upper, middle and lower portions 16C, 16M and 16Y/B is partially broken. The energized heating elements penetrate into the upper, middle and lower portions 16C, 16M and 16Y/B, and apply the pressure $P_1$ (0.1 MPa) involving a shearing force to the pressure-sensitive microcapsules 18C, 18M and 18Y, and the heat-sensitive microcapsule 18BK as shown in FIG. 11. Although the pressure-sensitive microcapsules 18C and 18M, and the heat-sensitive microcapsule 18BK are not broken by the breaking pressure $P_1$, the pressure-applied pressure-sensitive microcapsules 18Y are broken to release the yellow coloring composition, thereby producing yellow dots. Incidentally, melted waxes are provided from the binder particles 28, 24 and 20 to penetrate into the stonewall structure of the upper, middle and lower portions 16C, 16M and 16Y/B and the paper sheet 12 (not shown in FIG. 11).

When the pressure-sensitive, heat-sensitive recording medium 10 is conveyed between the fourth thermal head 30B and the fourth roller platen 32B, to the microcapsule layer 14 thereof is applied the breaking pressure $P_0$ of 0.01 MPa involving a shearing force by the fourth pressure-applying spring 34B through the heating elements $R_{b1}$, $R_{b2}$, $R_{b3}$, . . . , $R_{bn}$ of the fourth thermal head 30B. The breaking pressure $P_0$ is obstructed by the stonewall structure of the binder particles 20, 24 and 28 and cannot directly reach the pressure-sensitive microcapsules 18C, 18M and 18Y, and the heat-sensitive microcapsule 18BK.

If any of the heating elements $R_{b1}$, $R_{b2}$, $R_{b3}$, . . . , $R_{bn}$ of the fourth thermal head 30B is electrically energized, the energized heating elements are heated to a temperature $T_4$ (210° C.) higher than the melting temperatures of the binder particles 28, 24 and 20 each contained in the upper, middle or lower portion 16C, 16M or 16Y/B. The binder particles 28, 24 and 20 corresponding to the energized heating elements are softened or melted, whereby the stonewall structure of the upper, middle and lower portions 16C, 16M and 16Y/B is partially broken. The energized heating elements penetrate into the upper, middle and lower portions 16C, 16M and 16Y/B, and apply the pressure $P_0$ (0.01 MPa) involving a shearing force to the pressure-sensitive microcapsules 18C, 18M and 18Y, and the heat-sensitive microcapsule 18BK as shown in FIG. 11. Although the pressure-sensitive microcapsules 18C, 18M and 18Y are not broken by the breaking pressure $P_0$, the pressure-applied heat-sensitive microcapsules 18BK are broken by increased inner pressure at a temperature $T_4$ higher than the primary azeotropic point of the black coloring composition, to release the black coloring composition, thereby producing black dots.

The black dot may be generally obtained by putting three primary color dots, cyan dot, magenta dot and yellow dot, together. However, it is difficult to obtain deep black by mixing the three primary colors. Therefore, in this embodiment, the heat-sensitive microcapsule 18BK containing the black coloring composition is distributed in the lower portion 16Y/B, and selectively broken to exhibit the deep black dot.

Breaking of the heat-sensitive microcapsule 18BK is mostly due to the rapid increase of its inner pressure. If the pressure $P_0$ participates the breaking, being not important.

Although the pressure $P_0$ is 0.01 MPa in this embodiment, the pressure may be such that the pressure-sensitive, heat-sensitive recording medium 10 can be stably conveyed along the conveyer pathway 26 by the fourth roller platen 32B and that the microcapsule layer 14 of the pressure-sensitive, heat-sensitive recording medium 10 is moderately pressed to the heating elements $R_{b1}, \ldots, R_{bn}$ of the fourth thermal head 30B.

The full color image may be recorded on the microcapsule layer 14 by the three primary color dots and the black dot each produced in accordance with the pixel signals in the manner described above. In this full color image, a blue dot may be obtained by superposition of the cyan and magenta dots, a green dot may be obtained by superposition of the cyan and yellow dots, and a red dot may be obtained by superposition of the magenta and yellow dots.

The functions of the spacer particles 26 and 22 contained in the upper and middle portions 16C and 16M are described below.

For example, when any of the heating elements $R_{m1}$, $R_{m2}$, $R_{m3}$, . . . , $R_{mn}$ of the second thermal head 30M are electrically energized to form the magenta dot on the microcapsule layer 14, the binder particles 28 in the upper portion 16C are softened or melted by the energized heating elements beforehand, then, the binder particles 24 in the middle portion 16M are softened or melted. The energized heating elements are transitionally in such a condition that the elements penetrate into the upper portion 16C as shown in FIG. 9, before the elements penetrate into the middle portion 16M as shown in FIG. 10. At this time, although the pressure-sensitive microcapsules 18C in the upper portion 16C are applied the breaking pressure $P_2$ involving a shearing force to, the pressure-sensitive microcapsules 18C have the shell wall resisting the pressure $P_2$ to be not broken theoretically.

Each of the pressure-sensitive microcapsules 18C, 18M and 18Y are schematically shown with uniform diameter in the attached drawings, without intention of restricting the scope of the present invention. Among the pressure-sensitive microcapsules 18C, such a microcapsule that exceptionally having a large diameter may contain though the average diameter thereof is approximately 3 to 4 $\mu$m. When a shearing force provided by relative movement of the heating elements and the pressure-sensitive, heat-sensitive recording medium 10 is applied to the upper portion 16C, to the pressure-sensitive microcapsule 18C exceptionally having a large diameter is intensively applied the pressure involving the shearing force. As a result, the intensive pressure more than the predetermined pressure $P_2$ is applied to the pressure-sensitive microcapsule 18C having a large diameter, whereby there is a case where the microcapsule 18C having a large diameter is inappropriately broken to release the cyan coloring composition. The inappropriately released cyan coloring composition is appeared on the magenta image as a noise.

In this embodiment, the spacer particles 26 each having a diameter slightly larger than the average diameter of the pressure-sensitive microcapsules 18C are distributed in the upper portion 16C, to eliminate the intensive pressure from the microcapsules exceptionally having a large diameter at the transitional condition as possible, thereby suppressing such a noise. In short, the spacer particles 26 act to prevent the pressure-sensitive microcapsules 18C having a large diameter from being applied the unexpected shearing force provided by the relative movement of the heating elements and the pressure-sensitive, heat-sensitive recording medium 10 to.

The same is true in the case of the spacer particles 22 contained in the middle portion 16M. Thus, when only the yellow dots are recorded on the microcapsule layer 14, the spacer particles 22 each having a diameter slightly larger than the average diameter of the pressure-sensitive microcapsules 18M are distributed in the middle portion 16M, thereby suppressing that the pressure-sensitive microcapsules 18M exceptionally having a large diameter are inappropriately broken to release the magenta coloring composition as noise, as possible.

If the pressure-sensitive microcapsules 18C and 18M each have a uniform diameter, in other words, if there is no pressure-sensitive microcapsule having a exceptionally large diameter, the spacer particles 26 and 22 are not required to be distributed in the upper and middle portion 16C and 16M.

The average diameters of the pressure-sensitive microcapsule 18C, 18M and 18Y are increased in this order correspondingly to reduce of each predetermined breaking pressure $P_1$, $P_2$ and $P_3$. This enables to positively prevent the pressure-sensitive microcapsules 18C, 18M and 18Y from being inappropriately broken. For instance, in the case of the pressure-sensitive microcapsule 18Y, the breaking pressure $P_1$ is almost applied to the pressure-sensitive microcapsule 18Y with larger diameter than those of the pressure-sensitive microcapsules 18C and 18M, whereby to the pressure-sensitive microcapsules 18C and 18M are hardly applied the pressure.

In this embodiment of the third recording medium, Phthalocyanine blue is used as the cyan coloring matter contained in the cyan coloring composition, Rhodamine lake T is used as the magenta coloring matter contained in the magenta coloring composition, Benzine yellow G is used as the yellow coloring matter contained in the yellow coloring composition, and carbon black is used as the black coloring matter contained in the black coloring composition. A leuco-dye that exhibits cyan, magenta, yellow or black by a chemical reaction with a color-developing agent may be also used as the coloring matter. In the present invention, the cyan leuco-dye such as Benzoyl leuco methylene blue (BLMB) and Crystal violet lactone (CVL), the magenta leuco-dye such as "R-500" manufactured by Yamada Chemical Co., Ltd. and "Red-3" manufactured by Yamamoto Chemicals Inc., the yellow leuco-dye such as "IR-3" (Pergascript yellow) manufactured by Ciba-Geigy Corporation and "F color Yellow 17" manufactured by Yamamoto Chemicals Inc., and the black leuco-dye such as "Black 15" manufactured by Yamamoto Chemicals Inc., etc. may be used. In the case of using the leuco-dye, colorless color-developing agent such as zinc salicylate, activated clay, etc. is added to the upper, middle and lower portion 16C, 16M and 16Y/B.

When the leuco-dye is used in this embodiment, each of the microcapsules 16C, 16M and 16Y preferably has a shell wall made of a transparent material, whereby the microcapsules 16C, 16M and 16Y may be used for the paper sheet 12 exhibiting any color.

In this embodiment of the third recording medium, although KMC-113 is used as the vehicle contained in the cyan, magenta and yellow coloring compositions, other high boiling point transparent oils may also be used as the vehicle. Further, a low-boiling point wax that is melted at a temperature equal to or lower than the temperature $T_1$ may be used as the vehicle contained in the cyan, magenta and yellow coloring compositions.

In this embodiment, although the polypropylene wax, the microcrystalline wax or the paraffin wax is used for the binder particles 20, 24 and 28, other waxes having a desired melting temperature such as a montan wax and a carbana wax may be used. Further, low-melting point thermoplastic resins having a desired melting temperature, such as ethylene/vinyl acetate copolymer (EVA), polyethylenes, polyesters, poly(methyl methacrylate), etc., may be used for the binder particles 20, 24 and 28 instead of the wax.

High-melting point thermoplastic resins such as polyamide resins, polyimide resins, etc. which is not thermoplasticized at least at 250° C. may be used as a material for the shell wall of the pressure-sensitive microcapsules 18C, 18M and 18Y instead of the thermosetting resin. In this case, the high-melting point thermoplastic resin must exhibit a desired temperature/breaking pressure curve PC, PM, PY or PBK.

In this embodiment, although hydroxyapatite is used for the spacer particles 22 and 26, other inorganic materials such as silica, calcium carbonate, titanium dioxide, etc., or resins such as polyimides, polyamides, Teflons, polycarbonates, etc. may be used therefor.

To improve recording reliability of the pressure-sensitive, heat-sensitive recording medium 10 and quality of the image recorded thereon, various additives may be added to the portions 16C, 16M and 16Y/B. Examples of such additives include anti-adhesion agents that prevent the melt waxes and the released coloring compositions from adhering to the heating elements of the thermal heads 30C, 30M, 30Y and 30B, loading materials that rapidly adsorb the released coloring composition, ultraviolet screening agents and oxidation inhibitors that prevent recorded images from discoloration, etc.

Additionally, although the upper, middle and lower portions 16C, 16M and 16Y/B have the stonewall structure in this embodiment, they may have a solid wax binder structure in which the microcapsules and the optional spacer particles are uniformly distributed.

For example, the lower portion 16Y/B having the solid wax binder structure may be formed by a method comprising the steps of: mixing and stirring 20 g of PPW-5, 10 g of the pressure-sensitive microcapsule 18Y, 10 g of the heat-sensitive microcapsule 18BK and a small amount of a dispersing agent (sodium dodecylbenzenesulfonate) with 100 g of 3% aqueous solution of polyvinyl alcohol to obtain a suspension; spraying the suspension on the paper sheet 12 at a rate of approximately 5 g/m$^2$ and air-drying the resultant sheet; putting the dried sheet into an oven; and heating the sheet to a temperature equal to or higher than the melting temperature of PPW-5 (approximately 150° C.). In this method, PPW-5 is completely melted to form the solid wax binder layer (solid polypropylene wax layer), in which the pressure-sensitive microcapsules 18Y are uniformly distributed.

The middle and upper portions 16M and 16C may have the solid wax binder layer structure. The middle portion 16M may be formed as the solid wax binder layer by coating a suspension comprising CWP-3 on the lower portion 16Y/B, and by heating the suspension to a temperature equal to or higher than the melting temperature of CWP-3 (approximately 108° C.) after air-drying. The upper portion 16C may be formed as the solid wax binder layer by coating a suspension comprising paraffin wax particles on the second microcapsule layer 16M, and by heating the suspension to a temperature equal to or higher than the melting temperature of paraffin wax particles (approximately 73° C.) after air-drying.

In the case where the portions 16C, 16M and 16Y have the solid wax binder layer structure, the breaking pressures of the microcapsules contained therein are required to be somewhat high. This is because, in the case where a predetermined pressure is applied to the microcapsule layer 14 of the recording medium 10, a breaking pressure applied to the microcapsules in the solid wax binder layer structure is somewhat less than that applied to the microcapsules in the stonewall structure.

In this embodiment, the average diameter of the heat-sensitive microcapsules 18BK is smaller than those of the pressure-sensitive microcapsules 18C, 18M and 18Y, whereby the pressure-breaking characteristics of the microcapsules 18C, 18M and 18Y are not affected by the heat-sensitive microcapsule 18BK. If the heat-sensitive microcapsule 18BK is larger than other microcapsules, the heat-sensitive microcapsule 18BK has the same function as the spacer particles 26 and 28, whereby there is a case where the pressure-sensitive microcapsule 18C, 18M or 18Y is protected against the predetermined pressure by the heat-sensitive microcapsule 18BK, failing to be broken.

Further, although the heat-sensitive microcapsules 18BK are distributed in the lower portion 16Y/B in this embodiment, the heat-sensitive microcapsules 18BK may be distributed in the upper portion 16C, the middle portion 16M, or entire portions 16C, 16M and 16Y/B.

[D] Fourth Recording Medium

A fourth recording medium of the present invention is a pressure-sensitive, heat-sensitive recording medium comprising a substrate coated with a microcapsule layer. The microcapsule layer comprises upper and lower portions, the lower portion being disposed on the substrate, the upper portion being disposed on the lower portion.

The upper portion includes a plurality of first pressure-sensitive microcapsules uniformly distributed in a first binder having a predetermined melting temperature, the first pressure-sensitive microcapsules each containing a first coloring composition. The lower portion includes a plurality of second pressure-sensitive microcapsules and a plurality of heat-sensitive microcapsules uniformly distributed in a second binder having a melting temperature higher than the melting temperature of the first binder, the second pressure-sensitive microcapsules each containing a second coloring composition, the heat-sensitive microcapsules each containing a third coloring composition.

The first pressure-sensitive microcapsule is broken under a first pressure at a first temperature higher than the melting temperature of the first binder, the second pressure-sensitive microcapsule is broken under a second pressure lower than the first pressure at a second temperature higher than the melting temperature of the second binder, and the heat-sensitive microcapsule has such a temperature-breaking characteristic that the heat-sensitive microcapsule is broken by heating to a third temperature higher than the second temperature to release the third coloring composition.

The first and second binders, the first and second pressure-sensitive microcapsules, the first, second and third coloring compositions, the first, second and third temperatures, and the first, second and third pressures in the fourth recording medium are not needed to be the same as those in the third recording medium.

As the heat-sensitive microcapsule included in the lower portion, the above-mentioned first or second heat-sensitive microcapsule of the present invention may be preferably used. In the case of using the first heat-sensitive microcapsule of the present invention, the third coloring composition has a boiling point higher than the second temperature, and the first heat-sensitive microcapsule has such a temperature-breaking characteristic that the first heat-sensitive microcapsule is broken by heating to a temperature equal to or higher than the boiling point to release the third coloring composition. In the case of using the second heat-sensitive microcapsule of the present invention, the second heat-sensitive microcapsule comprises a heat decomposition-type gas-developing agent having a decomposition temperature higher than the second temperature, and the second heat-sensitive microcapsule has such a temperature-breaking characteristic that the second heat-sensitive microcapsule is broken by heating to a temperature equal to or higher than the decomposition temperature to release the third coloring composition.

According to the fourth recording medium of the present invention, it is preferred that an average diameter of the first pressure-sensitive microcapsules is smaller than an average diameter of the second pressure-sensitive microcapsules, and that the average diameter of the heat-sensitive microcapsules is smaller than an average diameter of the first pressure-sensitive microcapsules.

It is preferred that spacer particles having an average diameter larger than the average diameter of the first pressure-sensitive microcapsules are uniformly distributed in the upper portion. The spacer particles are preferably made of an inorganic material or a high-melting point synthetic resin.

Each of the upper and lower portions preferably has a stonewall structure where each of the first and second binders is composed of binder particles fused to each other. Each of the first and second coloring compositions may contain a vehicle and a coloring matter dispersed or dissolved in the vehicle. It is preferable that the coloring matter is a leuco-dye, each of the first and second binders comprising a color-developing agent for the leuco-dye. The first, second and third coloring compositions may exhibit three primary colors.

The microcapsule layer may include the microcapsules, the color-developing agent, the color-producing agent, the binder, the loading material, other additives such as wax, antistatic agent, antifoaming agent, conductant agent, fluorescent dye, surface active agent, ultraviolet-absorbing agent, precursors thereof, etc. Examples of the binder, the loading material and the substrate used for the fourth recording medium are the same as those in the case of the first recording medium. An embodiment of the fourth recording medium according to the present invention, in which the first heat-sensitive microcapsule of the present invention is used as the heat-sensitive microcapsule included in the lower portion, will be described in detail below with reference to the attached drawings without intention of restricting the scope of the present invention.

Figure 12:
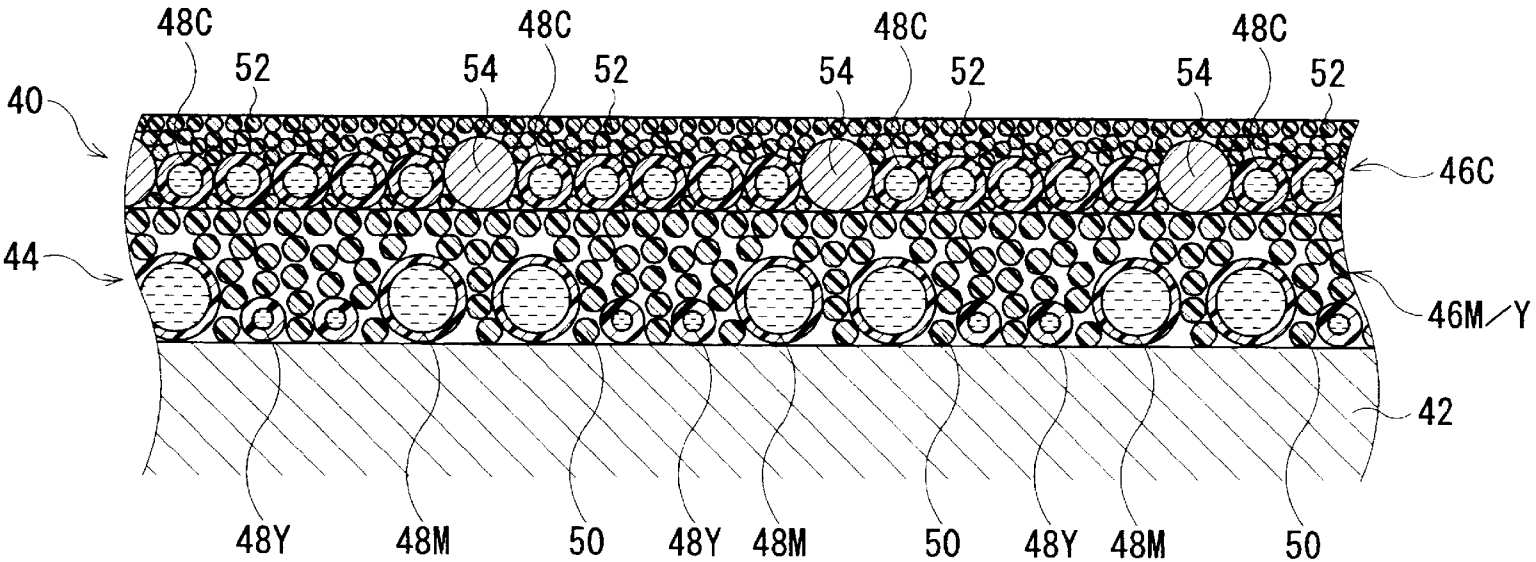
FIG. 12 is a partial, schematic, cross-sectional view showing an embodiment according to the fourth recording medium of the present invention.

FIG. 12 is a partial, schematic, cross-sectional view showing an embodiment according to the fourth recording medium of the present invention. The pressure-sensitive, heat-sensitive recording medium 40 shown in FIG. 12 has a paper sheet 42 as the substrate, which is coated with a microcapsule layer 44. The microcapsule layer 44 has a double layer structure comprising an upper portion 46C for recording a cyan image and a lower portion 46M/Y for selectively recording a magenta or yellow image, thereby recording a full color image. The lower portion 46M/Y is disposed on the paper sheet 42, and the upper portion 46C is disposed on the lower portion 46M/Y.

Figure 13:
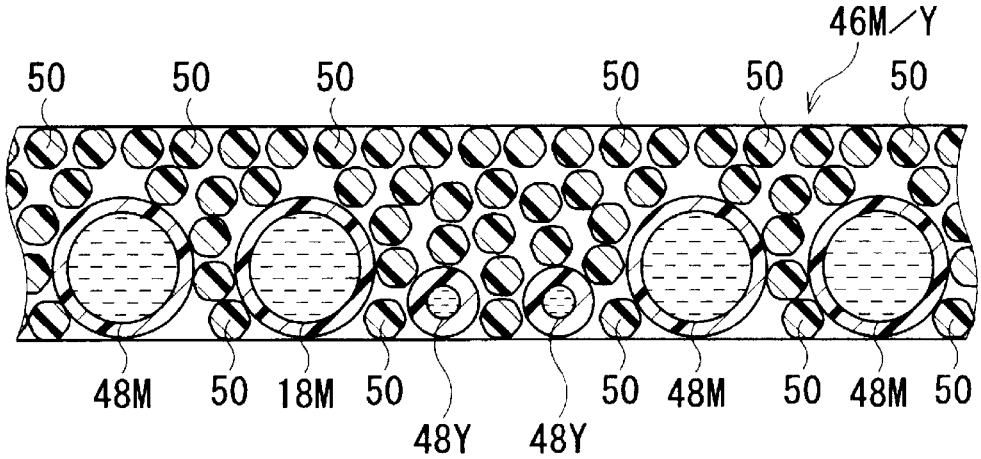
FIG. 13 is a partial, schematic, cross-sectional view showing a lower portion of the pressure-sensitive, heat-sensitive recording medium shown in FIG. 12.

FIG. 13 is a partial, schematic, cross-sectional view showing the lower portion 46M/Y of the pressure-sensitive, heat-sensitive recording medium 40 shown in FIG. 12. As shown in FIG. 13, the lower portion 46M/Y has a stonewall structure, where a plurality of second pressure-sensitive microcapsules 48M each containing a magenta coloring composition and a plurality of heat-sensitive microcapsules 48Y each containing a yellow coloring composition are uniformly distributed in wax-type binder particles 50.

A shell wall of the pressure-sensitive microcapsule 48M is made of a thermosetting amino resin having the same color as the paper sheet 42. The magenta coloring composition enclosed therein is prepared by mixing approximately 10 weight % of a magenta coloring matter with 100 weight % of a transparent oil. In this embodiment, "KMC-113" (2,7-diisopropyl naphthaline, boiling point: approximately 300° C.) manufactured by Rutgers Kreha Solvents Gmbh is used as the transparent oil, and "Rhodamine lake T" is used as the magenta coloring matter. The pressure-sensitive microcapsules 48M have an average diameter of approximately 6 to 7 $\mu$m, and the shell wall has a thickness selected such that the pressure-sensitive microcapsule 48M is broken under a pressure of 0.2 MPa or more involving a shearing force.

A shell wall of the heat-sensitive microcapsule 48Y is made of a thermosetting amino resin having the same color as the paper sheet 42. The yellow coloring composition enclosed therein is prepared by mixing approximately 10 weight % of a yellow coloring matter with 100 weight % of a transparent oil. In this embodiment, the transparent oil is such that is prepared by adding n-heptane to KMC-113 at a n-heptane/KMC-113 volume ratio of 20% to have a primary azeotropic point of approximately 150° C. Benzine yellow G is used as the yellow coloring matter. The heat-sensitive microcapsule 48Y have an average diameter of approximately 1 to 3 $\mu$m, and the shell wall has a thickness selected such that the heat-sensitive microcapsule 48Y is not broken even under a pressure of at least 0.2 MPa at a temperature lower than the primary azeotropic point of the yellow coloring composition (150° C.), and is broken by increased inner pressure thereof at a temperature equal to or higher than the primary azeotropic point to release the yellow coloring composition.

Used as the wax-type binder particle 50 may be a microcrystalline wax such as "CWP-3" manufactured by Seishin Enterprise Co., Ltd., etc. The wax-type binder particles 24 have an average diameter of approximately 3 to 5 $\mu$m and a melting temperature of approximately 108 ° C. The microcrystalline wax powder generally exhibits white color. The binder particle 50 may be the same as the binder particle 24 used in the middle portion 16M of an embodiment of the third recording medium according to the present invention.

The lower portion 46M/Y having the stonewall structure may be obtained by a method comprising the steps of: preparing 3% aqueous solution of polyvinyl alcohol (polymerization degree: 2,000); mixing and stirring 10 g of CWP-3, 10 g of the pressure-sensitive microcapsules 48M, 10 g of the heat-sensitive microcapsules 48Y and a small amount of a dispersing agent (sodium dodecylbenzenesulfonate) with 100 g of the aqueous solution to obtain a suspension; spraying the suspension on the paper sheet 42 at a rate of 5 g/m$^2$ and air-drying the resultant sheet; putting the dried sheet into an oven to heat to 103° C. lower than the melting temperature of CWP-3 (approximately 108° C.); and maintaining the temperature for approximately 15 minutes. By maintaining a predetermined temperature for a predetermined time, the binder particles 50 of CWP-3 are fused to each other to form the stonewall structure shown in FIG. 13.

When the binder particles 50 are in a solid state, in other words, when the lower portion 46M/Y is heated to a temperature lower than the melting temperature of the binder particle 50, the breaking pressure more than 0.2 MPa involving a shearing force is obstructed by the stonewall structure and cannot directly reach the pressure-sensitive microcapsule 48M, thereby breaking no microcapsule. When the lower portion 46M/Y is heated to a temperature, which is equal to or higher than the melting point of the binder particle 50 (108° C.) and is lower than the primary azeotropic point of the yellow coloring composition contained in the heat-sensitive microcapsule 48Y (150° C.), the binder particles 50 are softened or melted, whereby the pressure-sensitive microcapsule 48M is broken by the breaking pressure of 0.2 MPa or more involving the shearing force. On the other hand, even if the binder particles 50 are melted, the heat-sensitive microcapsule 48Y is not broken by the pressure of 0.2 MPa in the case of heating temperature lower than the primary azeotropic point of the yellow coloring composition. The pressure-sensitive microcapsule 48M is not broken and the heat-sensitive microcapsule 48Y is broken when the lower portion 46M/Y is heated to a temperature equal to or higher than the primary azeotropic point of the yellow coloring composition under a pressure less than 0.2 MPa. Thus, when the lower portion 46M/Y is heated to a temperature equal to or higher than the primary azeotropic point of the yellow coloring composition, the heat-sensitive microcapsule 48Y is broken by its increased inner pressure to release the yellow coloring composition.

Figure 14:
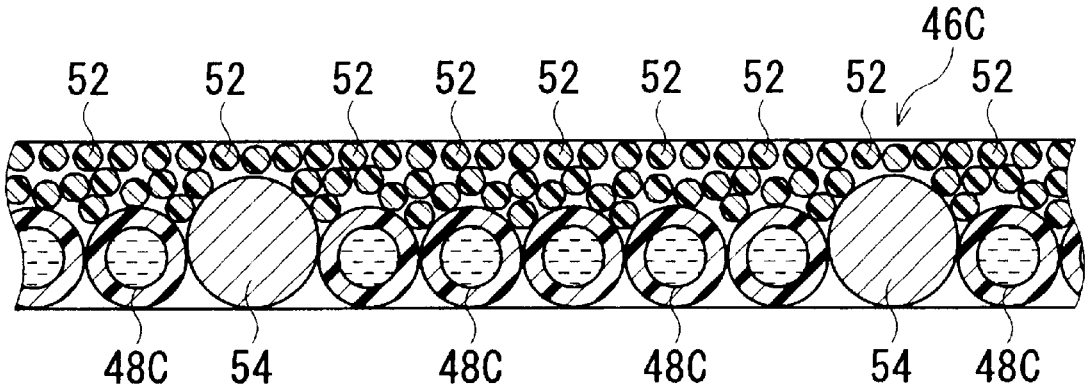
FIG. 14 is a partial, schematic, cross-sectional view showing an upper portion of the pressure-sensitive, heat-sensitive recording medium shown in FIG. 12.

FIG. 14 is a partial, schematic, cross-sectional view showing the upper portion 46C of the pressure-sensitive, heat-sensitive recording medium 40 shown in FIG. 12. As shown in FIG. 14, the upper portion 46C has a stonewall structure, where a plurality of first pressure-sensitive microcapsules 48C each containing a cyan coloring composition and a plurality of spacer particles 54 are uniformly distributed in a wax-type binder particles 52.

A shell wall of the pressure-sensitive microcapsule 48C is made of a thermosetting amino resin having the same color as the paper sheet 42. The cyan coloring composition enclosed therein is prepared by mixing approximately 10 weight % of a cyan coloring matter with 100 weight % of a transparent oil. In this embodiment, KMC-113 is used as the transparent oil, and Phthalocyanine blue is used as the cyan coloring matter. The pressure-sensitive microcapsules 48C have an average diameter of approximately 3 to 4 $\mu$m, and the shell wall has a thickness selected such that the pressure-sensitive microcapsule 48C is broken under a pressure of 2.0 MPa or more involving a shearing force. The spacer particles 52 are made of hydroxyapatite in this embodiment, and have an average diameter of approximately 5 to 6 $\mu$m larger than that of the pressure-sensitive microcapsules 48C. The wax-type binder particles 54 are made of a paraffin wax having a melting temperature of approximately 73° C., and have an average diameter of approximately 1 to 3 $\mu$m.

In short, the upper portion 46C is substantially the same as the above-mentioned upper portion 16C of the embodiment according to the third recording medium of the present invention. The upper portion 46C having a stonewall structure shown in FIG. 14 may be obtained in the same manner as the upper portion 16C.

When the binder particles 52 are in a solid state, in other words, when the upper portion 46C is heated to a temperature lower than the melting temperature of the binder particle 54, the breaking pressure of 2.0 MPa or more involving a shearing force is obstructed by the stonewall structure and cannot directly reach the pressure-sensitive microcapsule 48C, thereby breaking no microcapsule. When the upper portion 46C is heated to a temperature equal to or higher than the melting point of the binder particle 52 (73° C.), the binder particles 52 are softened or melted, whereby the pressure-sensitive microcapsule 48C is broken by the breaking pressure of 2.0 MPa or more involving the shearing force. Incidentally, functions of the spacer particle 54 included in the upper portion 46C are substantially the same as those of the spacer particle 26 mentioned above.

Figure 15:
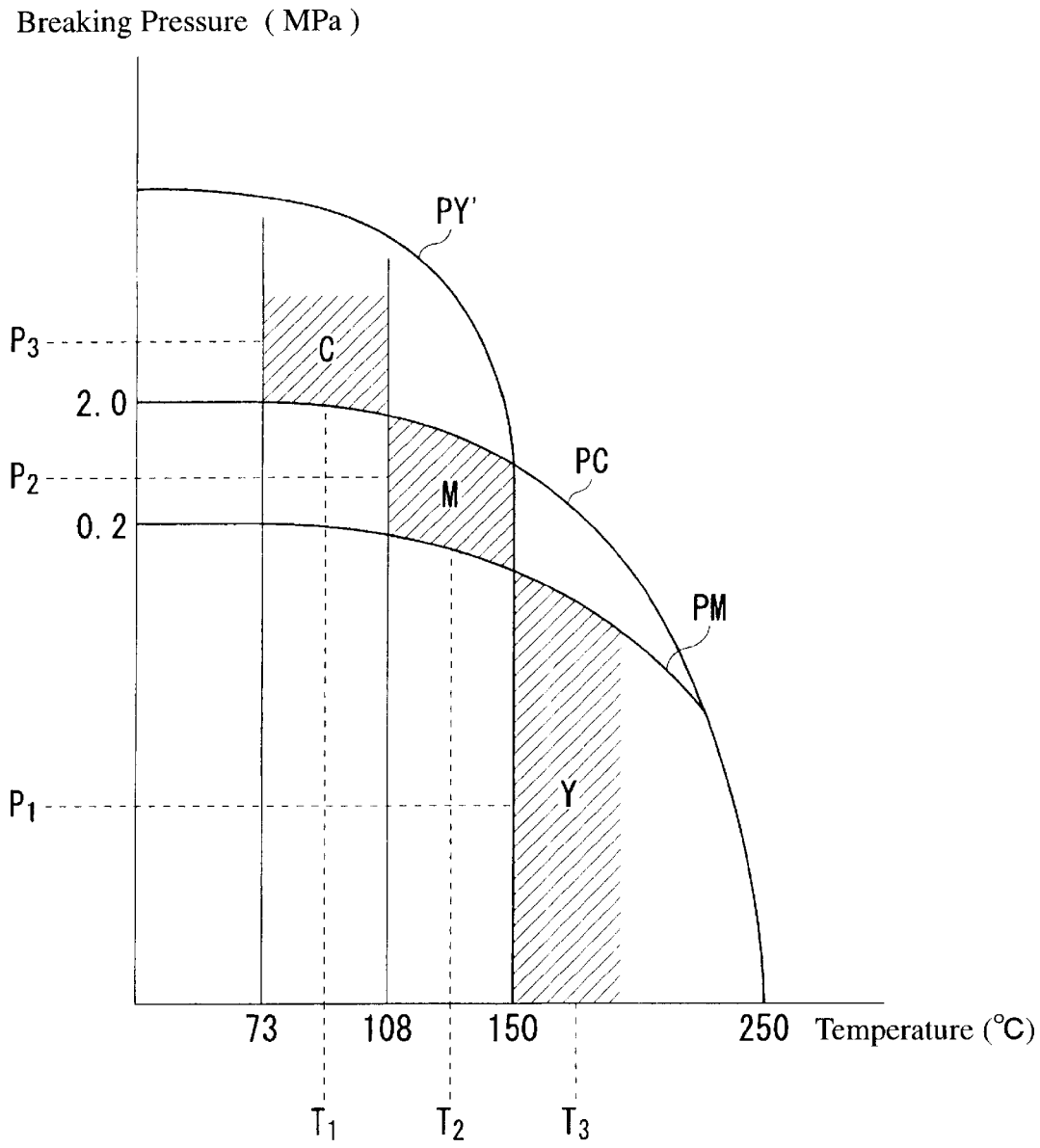
FIG. 15 is a graph showing a relation between temperature and breaking pressure according to three microcapsules included in the microcapsule layer of the pressure-sensitive, heat-sensitive recording medium shown in FIG. 12.

In short, the pressure-sensitive microcapsules 48C and 48M, and the heat-sensitive microcapsules 48Y each contained in the portions 46C or 46M/Y of the pressure-sensitive, heat-sensitive recording medium 40 exhibit temperature/pressure-breaking characteristics shown in a graph of FIG. 15.

As shown in FIG. 15, a cyan-exhibiting region C is provided by a temperature/breaking pressure curve PC according to the shell wall of the pressure-sensitive microcapsule 48C contained in the upper portion 46C, the melting temperature of the binder particle 54 contained in the upper portion 46C (73° C.), and the melting temperature of the binder particle 50 contained in the lower portion 46M/Y (108° C.). If a temperature $T_1$ and a pressure $P_3$ in the cyan exhibiting region C are applied to the microcapsule layer 44 of the pressure-sensitive, heat-sensitive recording medium 40, only the pressure-sensitive microcapsule 48C is broken to release the cyan coloring composition.

Also, as shown in FIG. 15, a magenta-exhibiting region M is provided by the temperature/breaking pressure curve PC, a temperature/breaking pressure curve PM according to the shell wall of the pressure-sensitive microcapsule 48M contained in the lower portion 46M/Y, the melting temperature of the binder particle 50 contained in the lower portion 46M/Y (108° C.), and the primary azeotropic point of the yellow coloring composition included in the heat-sensitive microcapsule 48Y contained in the lower portion 46M/Y (150° C.). If a temperature $T_2$ and a pressure $P_2$ in the magenta-exhibiting region M are applied to the microcapsule layer 44 of the pressure-sensitive, heat-sensitive recording medium 40, only the pressure-sensitive microcapsule 48M is broken to release the magenta coloring composition.

Further, as shown in FIG. 15, an yellow exhibiting region Y is provided by the temperature/breaking pressure curve PM and the primary azeotropic point of the yellow coloring composition included in the heat-sensitive microcapsule 48Y contained in the lower portion 46M/Y (150 ° C.). If a temperature $T_3$ and a pressure $P_1$ in the yellow exhibiting region Y are applied to the microcapsule layer 44 of the pressure-sensitive, heat-sensitive recording medium 40, only the heat-sensitive microcapsule 48Y is broken by the increased inner pressure to release the yellow coloring composition.

Thus, the pressure-sensitive microcapsules 48C and 48M, and the heat-sensitive microcapsule 48Y can be selectively broken by selecting the temperature and pressure which are applied to the microcapsule layer 44 of the pressure-sensitive, heat-sensitive recording medium 40. In this embodiment, the temperatures $T_1$, $T_2$, and $T_3$ are 90° C., 130° C. and 170° C., and the pressures $P_1$, $P_2$ and $P_3$ are 0.01 MPa, 1.0 MPa and 3.0 MPa, respectively.

As is clear from a temperature/breaking pressure curve PY' according to the heat-sensitive microcapsule 48Y shown in FIG. 15, the thickness of the shell wall of the heat-sensitive microcapsule 48Y is selected such that the heat-sensitive microcapsule 48Y is not broken at least under a pressure equal to or more than $P_3$, at a temperature lower than 150° C.

On the pressure-sensitive, heat-sensitive recording medium 40 shown in FIG. 12 may be recorded a color image by the image-recording device shown in FIGS. 7 and 8. In this embodiment, the pressure $P_1$ is 0.01 MPa, which is applied by the third pressure-applying spring 34Y. The fourth thermal head 30B, the fourth roller platen 32B and the fourth pressure-applying spring 34B may be omitted from the image-recording device. Process for producing a full color image on the pressure-sensitive, heat-sensitive recording medium 40 by the image-recording device shown in FIG. 7 is described below.

When the pressure-sensitive, heat-sensitive recording medium 40 is conveyed between the first thermal head 30C and the first roller platen 32C, to the microcapsule layer 44 thereof is applied the breaking pressure $P_3$ of 3.0 MPa involving a shearing force by the first pressure-applying spring 34C through the heating elements $R_{c1}$, $R_{c2}$, $R_{c3}$, . . . , $R_{cn}$, of the first thermal head 30C. The breaking pressure $P_3$ is obstructed by each portion having the stonewall structure and cannot directly reach the pressure-sensitive microcapsules 48C and 48M, and the heat-sensitive microcapsule 48Y.

Figure 16:
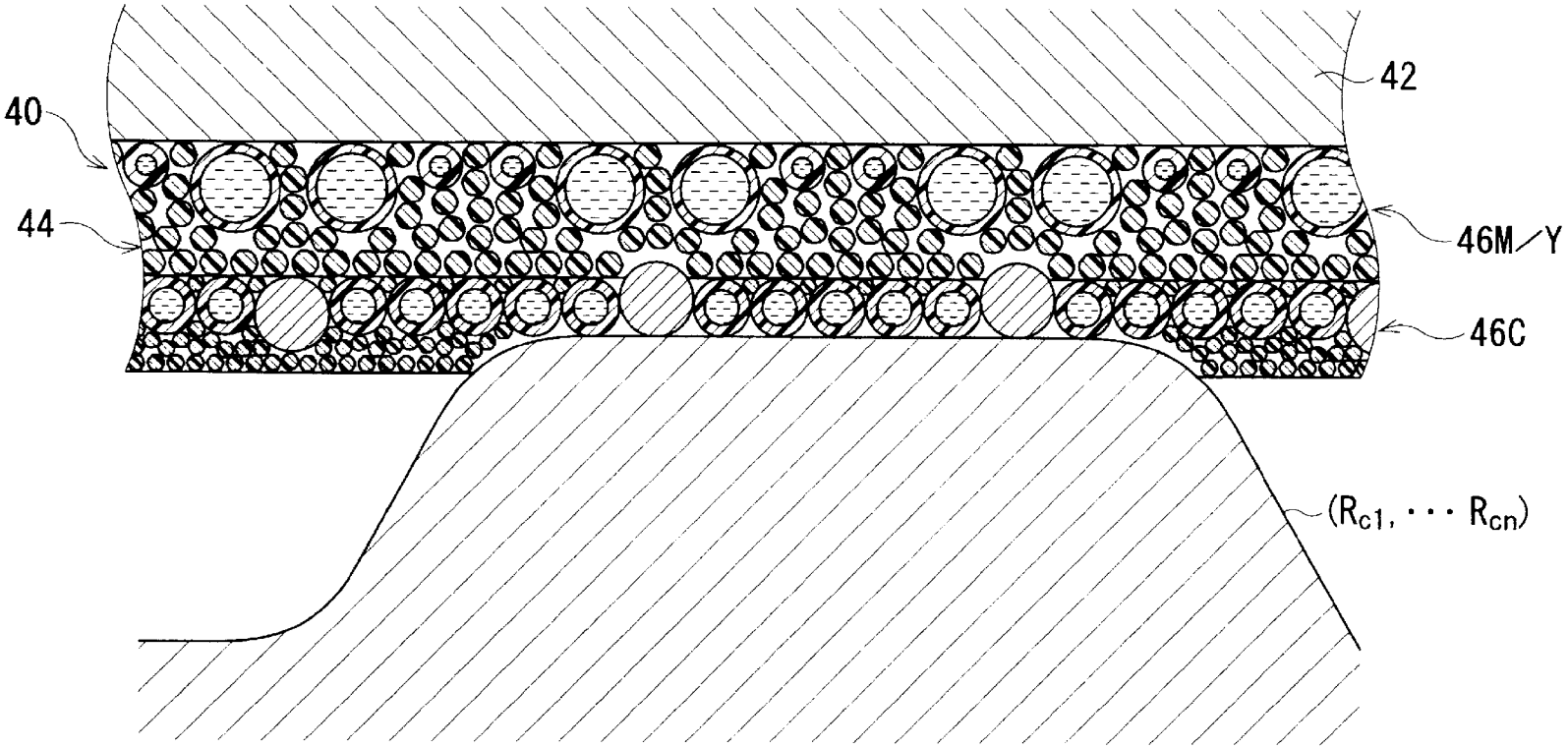
FIG. 16 is a partial, schematic, cross-sectional view showing a process for providing cyan dot on the upper portion of the pressure-sensitive, heat-sensitive recording medium shown in FIG. 12 by a heating element of the first thermal head of the image-recording device shown in FIG. 7.

If any of the heating elements $R_{c1}$, $R_{c2}$, $R_{c3}$, . . . , $R_{cn}$ of the first thermal head 30C is electrically energized, the energized heating elements are heated to a temperature $T_1$ (90° C.) higher than the melting temperature of the binder particle 52 contained in the upper portion 46C (73° C.). The binder particles 52 corresponding to the energized heating elements are softened or melted, whereby the stonewall structure of the upper portion 46C is partially broken. The energized heating elements penetrate into the upper portion 46C, and apply the pressure $P_3$ (3.0 MPa) involving a shearing force to the pressure-sensitive microcapsules 48C as shown in FIG. 16. Thus, the pressure-applied pressure-sensitive microcapsules 48C are broken to release the cyan coloring composition, thereby producing cyan dots.

When the pressure-sensitive, heat-sensitive recording medium 40 is conveyed between the second thermal head 30M and the second roller platen 32M, to the microcapsule layer 44 thereof is applied the breaking pressure $P_2$ of 1.0 MPa involving a shearing force by the second pressure-applying spring 34M through the heating elements $R_{m1}$, $R_{m2}$, $R_{m3}$, . . . , $R_{mn}$ of the second thermal head 30M. The breaking pressure $P_2$ is obstructed by the stonewall structure of the binder particles and cannot directly reach the pressure-sensitive microcapsules 48C and 48M, and the heat-sensitive microcapsule 48Y.

Figure 17:
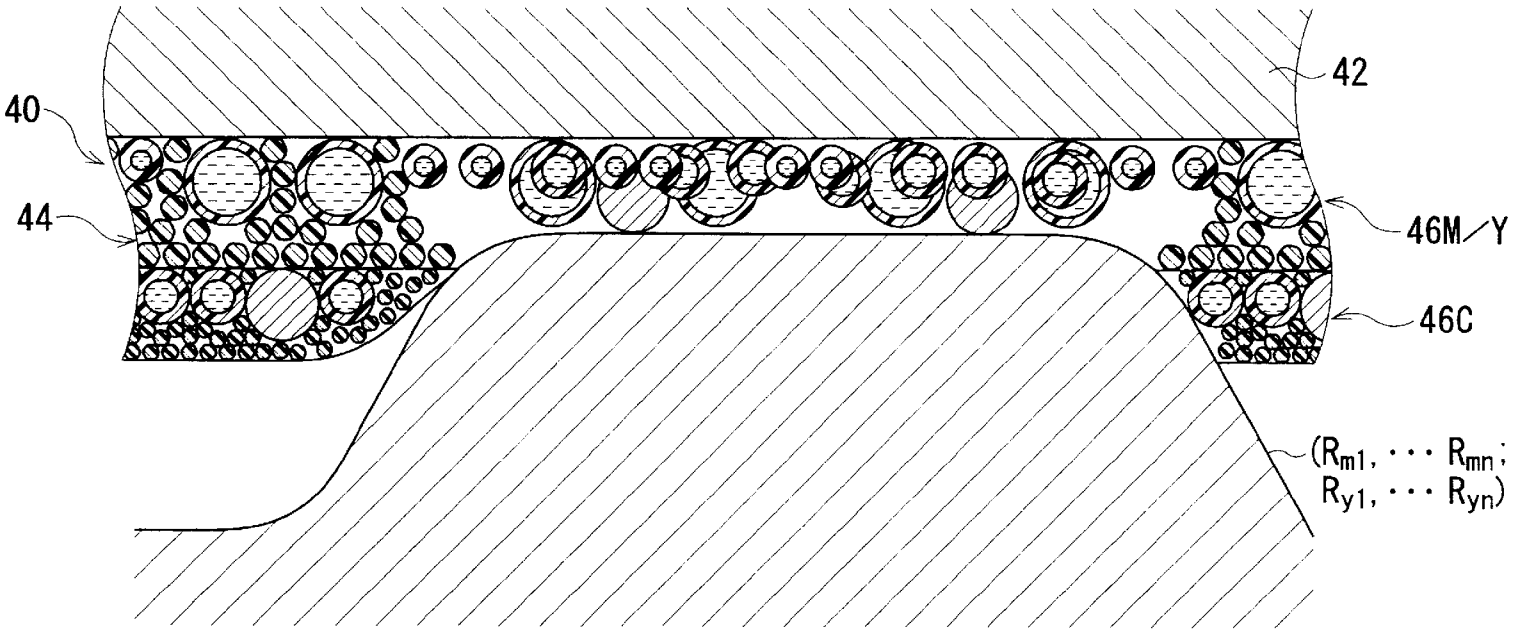
FIG. 17 is a partial, schematic, cross-sectional view showing a process for providing magenta or yellow dot on the lower portion of the pressure-sensitive, heat-sensitive recording medium shown in FIG. 12 by a heating element of the second or third thermal head of the image-recording device shown in FIG. 7.

If any of the heating elements $R_{m1}$, $R_{m2}$, $R_{m3}$, . . . , $R_{mn}$ of the second thermal head 30M is electrically energized, the energized heating elements are heated to a temperature $T_2$ (130° C.) higher than the melting temperatures of the binder particles 52 and 50 each contained in the upper or lower portion 46C or 46M/Y (73° C. and 108° C.). The binder particles 52 and 50 corresponding to the energized heating elements are softened or melted, whereby the stonewall structure of the upper and lower portions 46C and 46M/Y is partially broken. The energized heating elements penetrate into the upper and lower portion 46C and 46M/Y, and apply the pressure $P_2$ (1.0 MPa) involving a shearing force to the pressure-sensitive microcapsules 48C and 48M, and the heat-sensitive microcapsule 48Y as shown in FIG. 17. Although the pressure-sensitive microcapsule 48C and the heat-sensitive microcapsule 48Y are not broken by the breaking pressure $P_2$, the pressure-applied pressure-sensitive microcapsule 48M is broken to release the magenta coloring composition, thereby producing magenta dots.

When the pressure-sensitive, heat-sensitive recording medium 40 is conveyed between the third thermal head 30Y and the third roller platen 32Y, to the microcapsule layer 44 thereof is applied the breaking pressure $P_1$ of 0.01 MPa involving a shearing force by the third pressure-applying spring 34Y through the heating elements $R_{y1}$, $R_{y2}$, $R_{y3}$, . . . , $R_{yn}$ of the third thermal head 30Y. The breaking pressure $P_1$ is obstructed by the stonewall structure of the binder particles and cannot directly reach the pressure-sensitive microcapsules 48C and 48M, and the heat-sensitive microcapsule 48Y.

If any of the heating elements $R_{y1}$, $R_{y2}$, $R_{y3}$, . . . , $R_{yn}$ of the third thermal head 30Y is electrically energized, the energized heating elements are heated to a temperature $T_3$ (170° C.) higher than the melting temperatures of the binder particles 50 and 52 each contained in the upper or lower portion 46C or 46M/Y (73° C. and 108° C.) and the primary azeotropic point of the yellow coloring composition contained in the heat-sensitive microcapsule 48Y (150° C.). The binder particles 52 and 50 corresponding to the energized heating elements are softened or melted, whereby the stonewall structure of the upper and lower portions 46C and 46M/Y is partially broken. The energized heating elements penetrate into the upper and lower portions 46C and 46M/Y, and apply the pressure $P_1$ (0.01 MPa) involving a shearing force to the pressure-sensitive microcapsules 48C and 48M, and the heat-sensitive microcapsule 48Y as shown in FIG. 17. Although the pressure-sensitive microcapsules 48C and 48M are not broken by the breaking pressure $P_1$. The yellow coloring composition contained in the heat-sensitive microcapsule 48Y is heated to a temperature $T_3$ (170° C.) higher than the primary azeotropic point thereof (approximately 150° C.), so that the inner pressure of the heat-sensitive microcapsule 48Y is rapidly increased, whereby the heat-sensitive microcapsule 48Y is broken under a pressure $P_1$ to release the yellow coloring composition, thereby producing yellow dots.

Various changes and modifications mentioned above with regard to the third recording medium of the present invention may be made in the fourth recording medium of the present invention without departing from the spirit and scope thereof.

In this embodiment, breaking of the heat-sensitive microcapsule 48Y is mostly due to the rapid increase of its inner pressure. If the pressure $P_1$ participates the breaking, being not important. Although the pressure $P_1$ is 0.01 MPa in this embodiment, the pressure may be such that the pressure-sensitive, heat-sensitive recording medium 40 can be stably conveyed along the conveyer pathway 26 by the third roller platen 32Y and that the microcapsule layer 44 of the pressure-sensitive, heat-sensitive recording medium 40 is moderately pressed to the heating elements $R_{y1}$, . . . , $R_{yn}$ of the third thermal head 30Y.

[E] Fifth Recording Medium

A fifth recording medium of the present invention is a pressure-sensitive, heat-sensitive recording medium comprising a substrate coated with a microcapsule layer. The microcapsule layer includes a plurality of pressure-sensitive microcapsules and a plurality of heat-sensitive microcapsules uniformly distributed in a binder having a predetermined melting temperature, the pressure-sensitive microcapsules each containing a first coloring composition, the heat-sensitive microcapsules each containing a second coloring composition.

The pressure-sensitive microcapsule is broken under a predetermined pressure at a first temperature higher than the melting temperature of the binder, and the heat-sensitive microcapsule has such a temperature-breaking characteristic that the heat-sensitive microcapsule is broken by heating to a second temperature higher than the first temperature to release the second coloring composition.

The first and second coloring compositions, and the first and second temperatures are not needed to be the same as those in the third and fourth recording mediums.

As the heat-sensitive microcapsule included in the microcapsule layer, the above-mentioned first or second heat-sensitive microcapsule of the present invention may be preferably used. In the case of using the first heat-sensitive microcapsule of the present invention, the second coloring composition has a boiling point higher than the first temperature, and the first heat-sensitive microcapsule has such a temperature-breaking characteristic that the first heat-sensitive microcapsule is broken by heating to a temperature equal to or higher than the boiling point to release the second coloring composition. In the case of using the second heat-sensitive microcapsule of the present invention, the second heat-sensitive microcapsule comprises a heat decomposition-type gas-developing agent having a decomposition temperature higher than the first temperature, and the second heat-sensitive microcapsule has such a temperature-breaking characteristic that the second heat-sensitive microcapsule is broken by heating to a temperature equal to or higher than the decomposition temperature to release the second coloring composition.

According to the fifth recording medium of the present invention, it is preferred that an average diameter of the heat-sensitive microcapsules is smaller than an average diameter of the pressure-sensitive microcapsules. It is preferred that spacer particles having an average diameter larger than the average diameter of the pressure-sensitive microcapsules are uniformly distributed in the microcapsule layer. The spacer particles are preferably made of an inorganic material or a high-melting point synthetic resin.

The microcapsule layer preferably has a stonewall structure where the binder is composed of binder particles fused to each other. The first coloring composition may contain a vehicle and a coloring matter dispersed or dissolved in the vehicle. It is preferable that the coloring matter is a leuco-dye, the binder comprising a color-developing agent for the leuco-dye.

The microcapsule layer may include the microcapsules, the color-developing agent, the color-producing agent, the binder, the loading material, other additives such as wax, antistatic agent, antifoaming agent, conductant agent, fluorescent dye, surface active agent, ultraviolet-absorbing agent, precursors thereof, etc. Examples of the binder, the loading material and the substrate used for the fifth recording medium are the same as those in the case of the first recording medium. Various changes and modifications mentioned above with regard to the third recording medium of the present invention may be made in the fifth recording medium of the present invention without departing from the spirit and scope thereof.

[F] Sixth Recording Medium

A sixth recording medium of the present invention is a pressure-sensitive, heat-sensitive recording medium comprising a substrate coated with a microcapsule layer. The microcapsule layer includes a plurality of first pressure-sensitive microcapsules, a plurality of second pressure-sensitive microcapsules and a plurality of heat-sensitive microcapsules uniformly distributed in a binder having a predetermined melting temperature, the first pressure-sensitive microcapsules each containing a first coloring composition, the second pressure-sensitive microcapsules each containing a second coloring composition, the heat-sensitive microcapsules each containing a third coloring composition.

The first pressure-sensitive microcapsule is broken under a first pressure at a first temperature higher than the melting temperature of the binder, the second pressure-sensitive microcapsule is broken under a second pressure lower than the first pressure at a second temperature higher than the first temperature, and the heat-sensitive microcapsule has such a temperature-breaking characteristic that the heat-sensitive microcapsule is broken by heating to a third temperature higher than the second temperature to release the third coloring composition.

The first and second pressure-sensitive microcapsules, the first, second and third coloring compositions, the first, second and third temperatures, and the first and second pressures in the sixth recording medium are not needed to be the same as those in the third, fourth and fifth recording mediums.

As the heat-sensitive microcapsule included in the microcapsule layer, the above-mentioned first or second heat-sensitive microcapsule of the present invention may be preferably used. In the case of using the first heat-sensitive microcapsule of the present invention, the third coloring composition has a boiling point higher than the second temperature, and the first heat-sensitive microcapsule has such a temperature-breaking characteristic that the first heat-sensitive microcapsule is broken by heating to a temperature equal to or higher than the boiling point to release the third coloring composition. In the case of using the second heat-sensitive microcapsule of the present invention, the second heat-sensitive microcapsule comprises a heat decomposition-type gas-developing agent having a decomposition temperature higher than the second temperature, and the second heat-sensitive microcapsule has such a temperature-breaking characteristic that the second heat-sensitive microcapsule is broken by heating to a temperature equal to or higher than the decomposition temperature to release the third coloring composition.

According to the sixth recording medium of the present invention, it is preferred that an average diameter of the first pressure-sensitive microcapsules is smaller than an average diameter of the second pressure-sensitive microcapsules, and that an average diameter of the heat-sensitive microcapsules is smaller than the average diameter of the first pressure-sensitive microcapsules.

The second pressure-sensitive microcapsule preferably has a double shell wall structure comprising an inner shell wall and an outer shell wall, one of the inner and outer shell walls being melted or softened at the second temperature. It is preferable that spacer particles having an average diameter larger than the average diameter of the first pressure-sensitive microcapsules are uniformly distributed in the microcapsule layer. The spacer particles are preferably made of an inorganic material or a high-melting point synthetic resin.

The microcapsule layer preferably has a stonewall structure where the binder is composed of binder particles fused to each other. Each of the first and second coloring compositions may contain a vehicle and a coloring matter dispersed or dissolved in the vehicle. It is preferable that the coloring matter is a leuco-dye, the binder comprising a color-developing agent for the leuco-dye. The first, second and third coloring compositions may exhibit three primary colors.

The microcapsule layer may include the microcapsules, the color-developing agent, the color-producing agent, the binder, the loading material, other additives such as wax, antistatic agent, antifoaming agent, conductant agent, fluorescent dye, surface active agent, ultraviolet-absorbing agent, precursors thereof, etc. Examples of the binder, the loading material and the substrate used for the fourth recording medium are the same as those in the case of the first recording medium. An embodiment of the sixth recording medium according to the present invention, in which the first heat-sensitive microcapsule of the present invention is used as the heat-sensitive microcapsule included in the microcapsule layer, will be described in detail below with reference to the attached drawings without intention of restricting the scope of the present invention.

Figure 18:
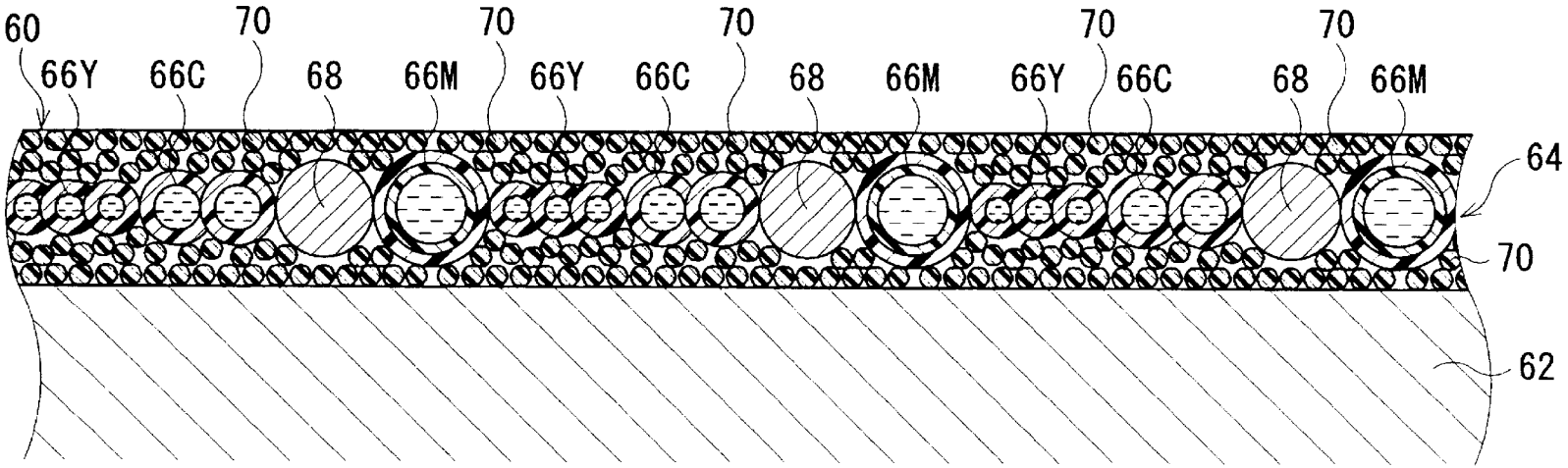
FIG. 18 is a partial, schematic, cross-sectional view showing an embodiment according to the sixth recording medium of the present invention.

FIG. 18 is a partial, schematic, cross-sectional view showing an embodiment according to the sixth recording medium of the present invention. The pressure-sensitive, heat-sensitive recording medium 60 shown in FIG. 18 has a paper sheet 62 as the substrate, which is coated with a microcapsule layer 64.

The microcapsule layer 64 has a stonewall structure, where a plurality of first pressure-sensitive microcapsules 66C each containing a cyan coloring composition, a plurality of second pressure-sensitive microcapsules 66M each containing a magenta coloring composition, a plurality of heat-sensitive microcapsules 66Y each containing a yellow coloring composition, and a plurality of spacer particles 68 are uniformly distributed in wax-type binder particles 70. The pressure-sensitive microcapsule 66C is used for recording a cyan image, the pressure-sensitive microcapsule 66M is used for recording a magenta image, and the heat-sensitive microcapsule 66Y is used for recording a yellow image, whereby on the microcapsule layer 64 may be recorded a full color image.

A shell wall of the pressure-sensitive microcapsule 66C is made of a thermosetting amino resin having the same color as the paper sheet 62. The cyan coloring composition enclosed therein is prepared by mixing approximately 10 weight % of Phthalocyanine blue with 100 weight % of KMC-113 (2,7-diisopropyl naphthaline, boiling point: approximately 300° C.) manufactured by Rutgers Kreha Solvents Gmbh. The pressure-sensitive microcapsules 66C have an average diameter of approximately 3 to 4 $\mu$m, and the shell wall has a thickness selected such that the pressure-sensitive microcapsule 66C is broken under a pressure of 2.0 MPa or more involving a shearing force.

Figure 19:
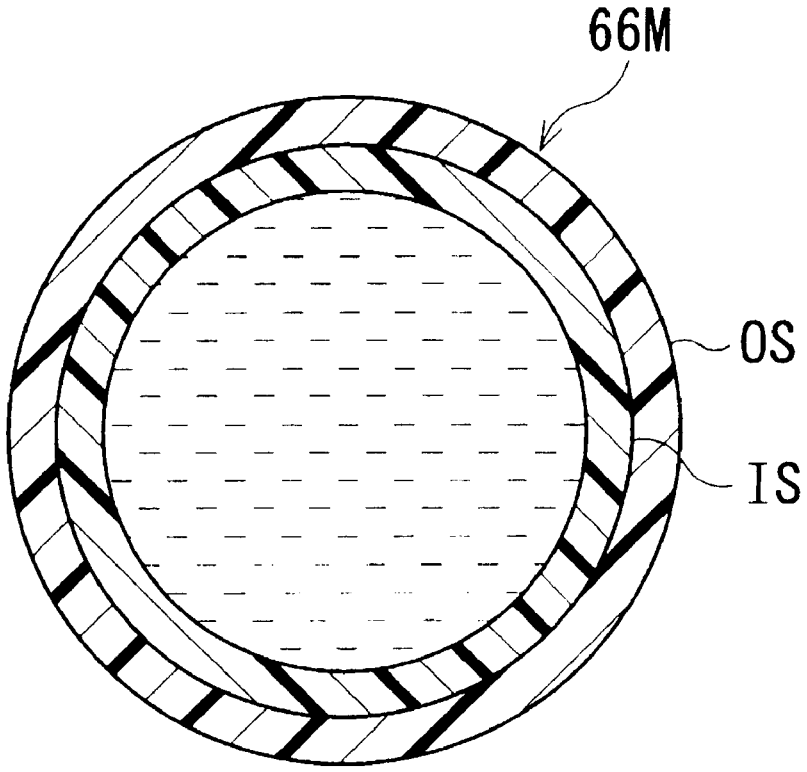
FIG. 19 is a schematic, cross-sectional view showing a microcapsule comprising double shell wall included in a microcapsule layer of the pressure-sensitive, heat-sensitive recording medium shown in FIG. 18.

In this embodiment, the pressure-sensitive microcapsule 66M has a double shell wall structure shown in FIG. 19. An inner shell wall IS is made of an amino resin, and an outer shell wall OS is made of a wax having the same color as the paper sheet 62. The outer shell wall OS may be disposed on the outer surface of the above-described pressure-sensitive microcapsule 18M by known spray-dry method, phase separation method, etc. to obtain such a pressure-sensitive microcapsule 66M. The wax for the outer shell wall OS may be a microcrystalline wax such as CWP-3 manufactured by Seishin Enterprise Co., Ltd., etc. The magenta coloring composition enclosed therein is prepared by mixing Rhodamine lake T with KMC-113. The pressure-sensitive microcapsules 66M have an average diameter of approximately 6 to 7 $\mu$m.

Figure 20:
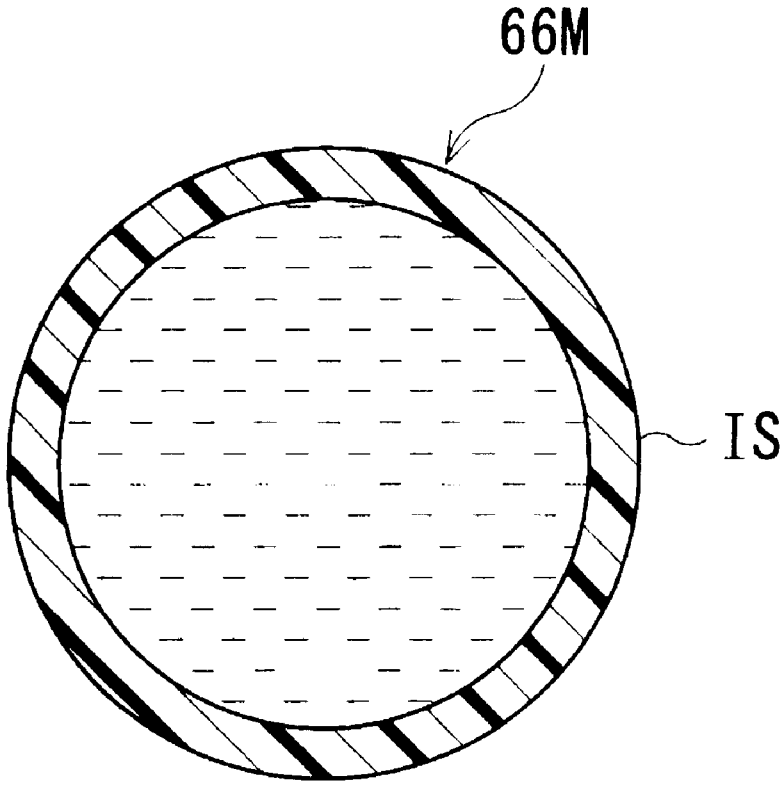
FIG. 20 is a schematic, cross-sectional view showing the microcapsule obtained by melting an outer shell wall of the microcapsule shown in FIG. 19.

The pressure-sensitive microcapsule 66M having a double shell wall structure exhibits high resistance to a pressure more than 2.0 MPa involving a shearing force at a temperature lower than the melting point of the outer shell wall OS (108° C.) by cooperatively of the inner and outer shell walls IS and OS. When the pressure-sensitive microcapsule 66M is heated to a temperature equal to or higher than the melting point of the outer shell wall OS, the outer shell wall OS is melted to obtain the pressure-sensitive microcapsule 66M shown in FIG. 20 having only the inner shell wall IS. The pressure-sensitive microcapsule 66M without the outer shell wall OS shown in FIG. 20 has a temperature/pressure-breaking characteristic substantially the same as that of the pressure-sensitive microcapsule 18M.

A shell wall of the heat-sensitive microcapsule 66Y is made of a thermosetting amino resin having the same color as the paper sheet 62. The yellow coloring composition enclosed therein is prepared by mixing approximately 10 weight % of Benzine yellow G with 100 weight % of a transparent oil. The heat-sensitive microcapsule 66Y have an average diameter of approximately 1 to 3 $\mu$m. In this embodiment, the transparent oil is such that is prepared by adding n-heptane to KMC-113 at a n-heptane/KMC-113 volume ratio of 20% to have a primary azeotropic point of approximately 150° C. Xylene, benzene, naphthaline, etc. may be added to the transparent oil instead of n-heptane to obtain a desired boiling point. The shell wall has a thickness selected such that the heat-sensitive microcapsule 66Y is not broken even under a pressure more than 3.0 MPa at a temperature lower than the primary azeotropic point of the yellow coloring composition (150° C.).

In this embodiment, the spacer particles 68 are made of hydroxyapatite and have an average diameter of approximately 5 to 6 $\mu$m larger than that of the pressure-sensitive microcapsules 66C. Incidentally, functions of the spacer particle 68 are substantially the same as those of the spacer particle 26 mentioned above.

Used as the wax-type binder particle 70 may be a paraffin wax having a melting temperature of approximately 73° C. Such a wax-type binder particles 70 may be obtained by grinding a paraffin wax into a particles with an average diameter of approximately 1 to 3 $\mu$m by a jet mill.

The microcapsule layer 64 having the stonewall structure may be obtained by a method comprising the steps of: preparing 3% aqueous solution of polyvinyl alcohol (polymerization degree: 2,000); mixing and stirring 2.5 g of the spacer particles 68, 5 g of the paraffin wax particles (binder particles 70), 5 g of the pressure-sensitive microcapsules 66C, 5 g of the pressure-sensitive microcapsules 66M, 7.5 g of the heat-sensitive microcapsules 66Y and a small amount of a dispersing agent (sodium dodecylbenzenesulfonate) with 100 g of the aqueous solution to obtain a suspension; spraying the suspension on the paper sheet 62 at a rate of 8 to 10 g/m$^2$ and air-drying the resultant sheet; putting the dried sheet into an oven to heat to 68° C. lower than the melting temperature of the paraffin wax (approximately 73° C.); and maintaining the temperature for approximately 15 minutes. By maintaining a predetermined temperature for a predetermined time, the binder particles 70 of the paraffin wax are fused to each other to form the stonewall structure shown in FIG. 18.

When the binder particles 70 are in a solid state, in other words, when the microcapsule layer 64 is heated to a temperature lower than the melting temperature of the binder particle 70 (73° C.), the breaking pressure more than 2.0 MPa involving a shearing force is obstructed by the stonewall structure and cannot directly reach the pressure-sensitive microcapsules 66C and 66M, and the heat-sensitive microcapsule 66Y, thereby breaking no microcapsule.

When the microcapsule layer 64 is heated to a temperature, which is equal to or higher than the melting point of the binder particle 70 (73° C.) and is lower than the melting point of the outer shell wall OS (108° C.), the binder particles 70 are softened or melted, whereby to the pressure-sensitive microcapsules 66C and 66M, and the heat-sensitive microcapsule 66Y is directly applied a breaking pressure of 2.0 MPa or more involving the shearing force. The pressure-sensitive microcapsule 66M with the outer shell wall OS and the heat-sensitive microcapsule 66Y can resist the breaking pressure, so that only the pressure-sensitive microcapsule 66C is broken by the pressure.

When the microcapsule layer 64 is heated to a temperature, which is equal to or higher than the melting point of the outer shell wall OS (108° C.) and is lower than the primary azeotropic point of the yellow coloring composition (150° C.), the binder particles 70 and the outer shell wall OS of the pressure-sensitive microcapsule 66M are softened or melted, whereby to the pressure-sensitive microcapsules 66C and 66M, and the heat-sensitive microcapsule 66Y is directly applied a breaking pressure involving the shearing force, which is equal to or more than 0.2 MPa and is less than 2.0 MPa. The pressure-sensitive microcapsule 66C and the heat-sensitive microcapsule 66Y can resist this pressure, so that only the pressure-sensitive microcapsule 66M without the outer shell wall OS is broken by the pressure.

When the microcapsule layer 64 is heated to a temperature equal to or higher than the primary azeotropic point of the yellow coloring composition (150° C.), the binder particles 70 and the outer shell wall OS of the pressure-sensitive microcapsule 66M are softened or melted. If a breaking pressure less than 0.2 MPa is applied to this, the pressure-sensitive microcapsules 66C and 66M can resist this pressure, so that only the heat-sensitive microcapsule 66Y is broken. Thus, the heat-sensitive microcapsule 66Y is broken by the increased inner pressure to release the yellow coloring composition when the microcapsule layer 64 is heated to a temperature equal to or higher than the primary azeotropic point of the yellow coloring composition.

Figure 21:
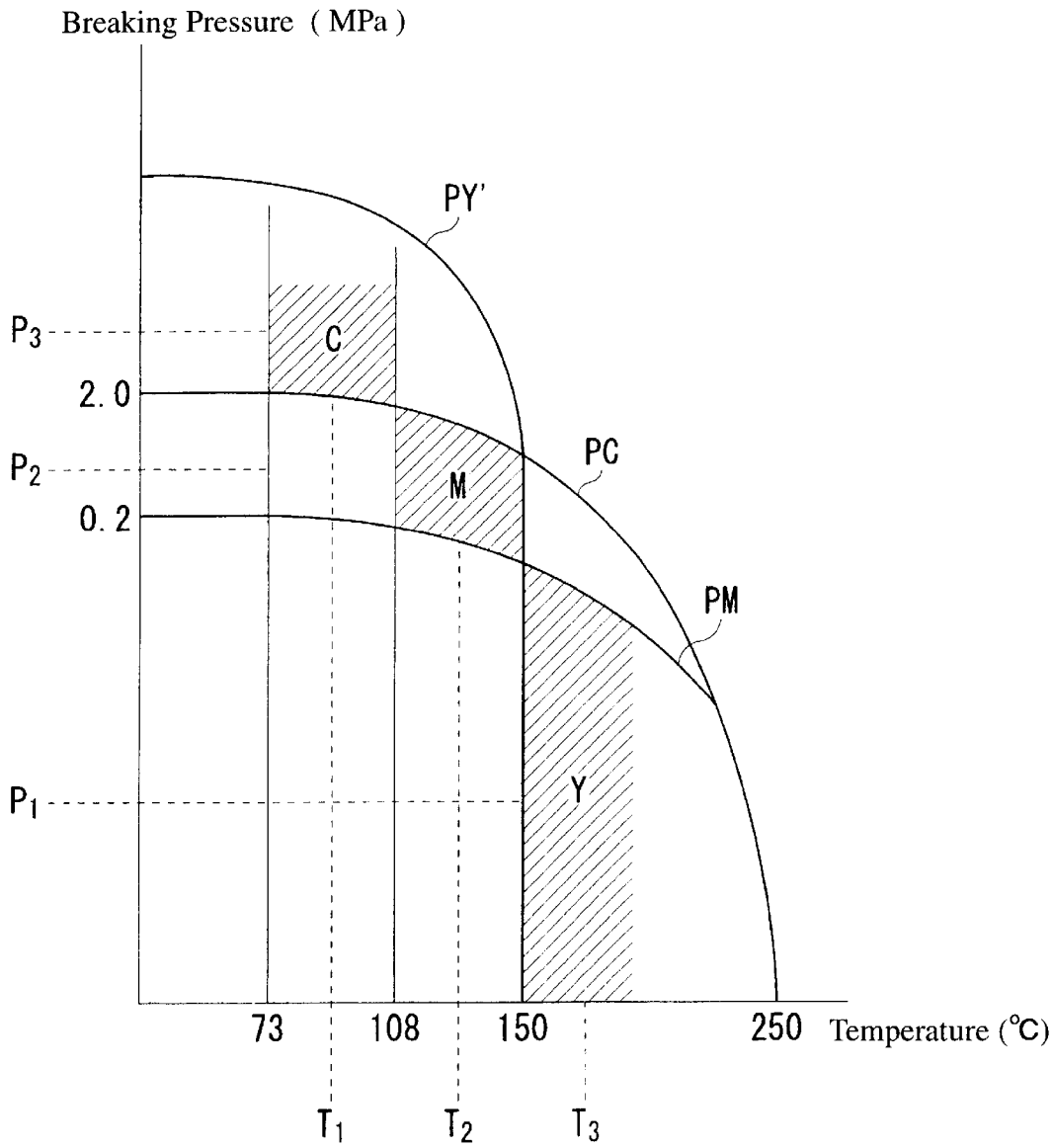
FIG. 21 is a graph showing a relation between temperature and breaking pressure according to three microcapsules included in a microcapsule layer of the pressure-sensitive, heat-sensitive recording medium shown in FIG. 18.

In short, the pressure-sensitive microcapsules 66C and 66M, and the heat-sensitive microcapsule 66Y each contained in the microcapsule layer 64 of the pressure-sensitive, heat-sensitive recording medium 60 exhibit temperature/pressure-breaking characteristics shown in a graph of FIG. 21. Incidentally, the temperature/pressure-breaking characteristics shown in FIG. 21 is substantially the same as those of the pressure-sensitive microcapsules 48C and 48M, and the heat-sensitive microcapsule 48Y each contained in an embodiment of the fourth recording medium.

As shown in FIG. 21, a cyan-exhibiting region C is provided by a temperature/breaking pressure curve PC according to the shell wall of the pressure-sensitive microcapsule 66C, the melting temperature of the binder particle 70 (73° C.), and the melting temperature of the outer shell wall OS of the pressure-sensitive microcapsule 66M (108° C.). If a temperature $T_1$ and a pressure $P_3$ in the cyan exhibiting region C are applied to the microcapsule layer 64 of the pressure-sensitive, heat-sensitive recording medium 60, only the pressure-sensitive microcapsule 66C is broken to release the cyan coloring composition.

Also, as shown in FIG. 21, a magenta-exhibiting region M is provided by the temperature/breaking pressure curve PC, a temperature/breaking pressure curve PM according to the inner shell wall IS of the pressure-sensitive microcapsule 66M after melt of the outer shell wall OS, the melting temperature of the outer shell wall OS (108° C.), and the primary azeotropic point of the yellow coloring composition included in the heat-sensitive microcapsule 66Y (150° C.). If a temperature $T_2$ and a pressure $P_2$ in the magenta-exhibiting region M are applied to the microcapsule layer 64 of the pressure-sensitive, heat-sensitive recording medium 60, only the pressure-sensitive microcapsule 66M is broken to release the magenta coloring composition.

Further, as shown in FIG. 21, an yellow exhibiting region Y is provided by the temperature/breaking pressure curve PM and the primary azeotropic point of the yellow coloring composition (150° C.). If a temperature $T_3$ and a pressure $P_1$ in the yellow exhibiting region Y are applied to the microcapsule layer 64 of the pressure-sensitive, heat-sensitive recording medium 60, only the heat-sensitive microcapsule 66Y is broken by the increased inner pressure to release the yellow coloring composition.

Thus, the pressure-sensitive microcapsules 66C and 66M, and the heat-sensitive microcapsule 66Y can be selectively broken by selecting the temperature and pressure which are applied to the microcapsule layer 64 of the pressure-sensitive, heat-sensitive recording medium 60. In this embodiment, the temperatures $T_1$, $T_2$, and $T_3$ are 90° C., 130° C. and 170° C., and the pressures $P_1$, $P_2$ and $P_3$ are 0.01 MPa, 1.0 MPa and 3.0 MPa, respectively.

As is clear from a temperature/breaking pressure curve PY' according to the heat-sensitive microcapsule 66Y shown in FIG. 21, the thickness of the shell wall of the heat-sensitive microcapsule 66Y is selected such that the heat-sensitive microcapsule 66Y is not broken at least under a pressure $P_3$ (3.0 MPa) or more, at a temperature lower than 150° C.

On the pressure-sensitive, heat-sensitive recording medium 60 shown in FIG. 18 may be recorded a color image by the image-recording device shown in FIGS. 7 and 8. In this embodiment, the pressure $P_1$ is 0.01 MPa, which is applied by the third pressure-applying spring 34Y. The fourth thermal head 30B, the fourth roller platen 32B and the fourth pressure-applying spring 34B may be omitted from the image-recording device. Process for producing a full color image on the pressure-sensitive, heat-sensitive recording medium 60 by the image-recording device shown in FIG. 7 is described below.

When the pressure-sensitive, heat-sensitive recording medium 60 is conveyed between the first thermal head 30C and the first roller platen 32C, to the microcapsule layer 64 thereof is applied the breaking pressure $P_3$ of 3.0 MPa involving a shearing force by the first pressure-applying spring 34C through the heating elements $R_{c1}$, $R_{c2}$, $R_{c3}$, . . . , $R_{cn}$ of the first thermal head 30C. The breaking pressure $P_3$ is obstructed by the binder layer having the stonewall structure and cannot directly reach the pressure-sensitive microcapsules 66C and 66M, and the heat-sensitive microcapsule 66Y.

Figure 22:
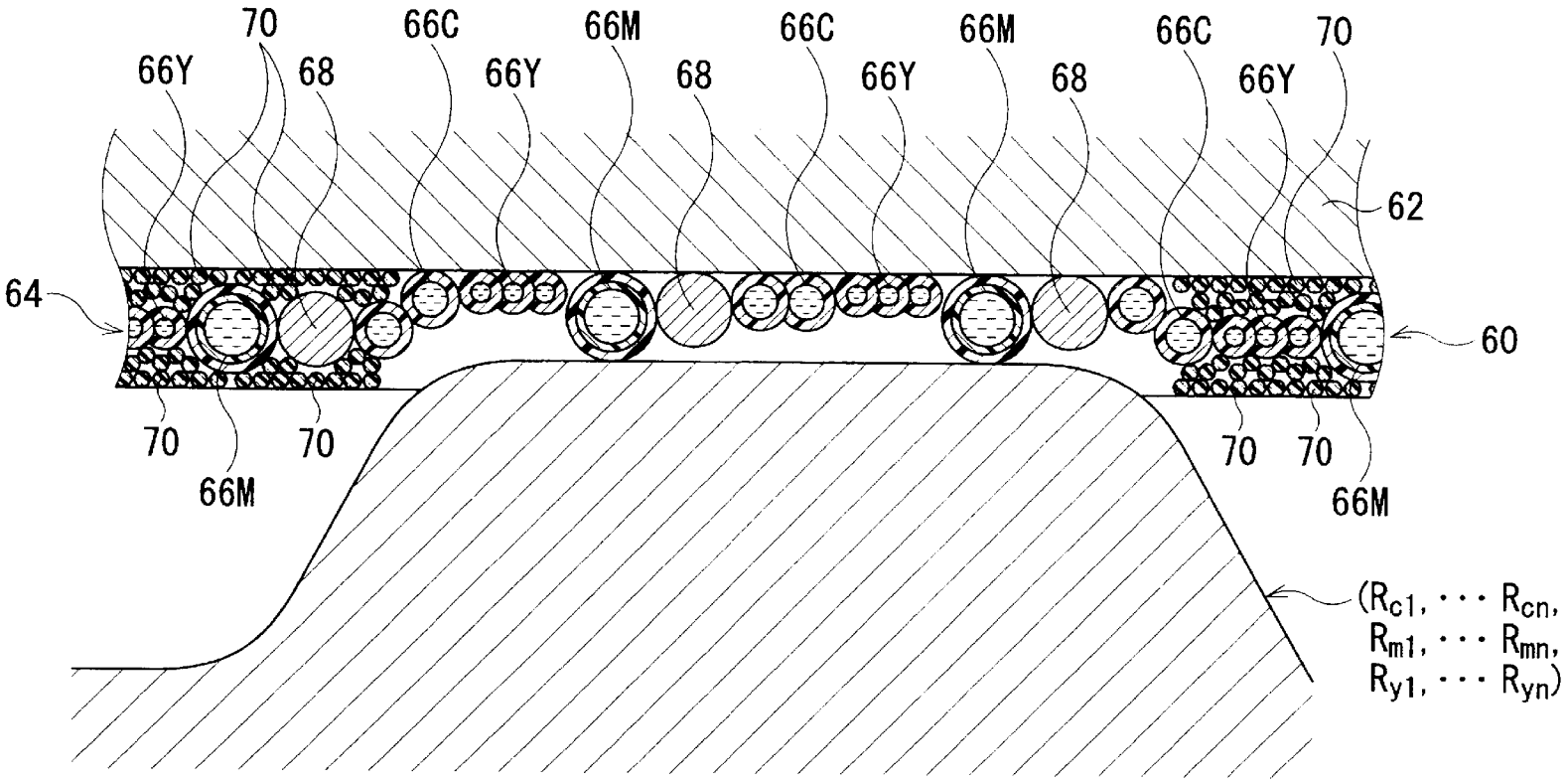
FIG. 22 is a partial, schematic, cross-sectional view showing a process for providing cyan, magenta or yellow dot on the microcapsule layer of the pressure-sensitive, heat-sensitive recording medium shown in FIG. 18 by a heating element of the first, second or third thermal head of the image-recording device shown in FIG. 7.

If any of the heating elements $R_{c1}$, $R_{c2}$, $R_{c3}$, . . . , $R_{cn}$ of the first thermal head 30C is electrically energized, the energized heating elements are heated to a temperature $T_1$ (90° C.) higher than the melting temperature of the binder particle 70 contained in the microcapsule layer 64 (73° C.). The binder particles 70 corresponding to the energized heating elements are softened or melted, whereby the stonewall structure of the microcapsule layer 64 is partially broken. The energized heating elements penetrate into the microcapsule layer 64, and apply the pressure $P_3$ (3.0 MPa) involving a shearing force to the pressure-sensitive microcapsules 66C and 66M, and the heat-sensitive microcapsule 66Y as shown in FIG. 22. As mentioned above, the pressure-sensitive microcapsule 66C is broken under such a condition to release the cyan coloring composition, thereby producing cyan dots.

When the pressure-sensitive, heat-sensitive recording medium 60 is conveyed between the second thermal head 30M and the second roller platen 32M, to the microcapsule layer 64 thereof is applied the breaking pressure $P_2$ of 1.0 MPa involving a shearing force by the second pressure-applying spring 34M through the heating elements $R_{m1}$, $R_{m2}$, $R_{m3}$, . . . , $R_{mn}$ of the second thermal head 30M. The breaking pressure $P_2$ is obstructed by the stonewall structure of the binder particles and cannot directly reach the pressure-sensitive microcapsules 66C and 66M, and the heat-sensitive microcapsule 66Y.

If any of the heating elements $R_{m1}$, $R_{m2}$, $R_{m3}$, . . . , $R_{mn}$ of the second thermal head 30M is electrically energized, the energized heating elements are heated to a temperature $T_2$ (130° C.) higher than the melting temperatures of the binder particles 70 and the outer shell wall OS (73° C. and 108° C.). The binder particles 70 corresponding to the energized heating elements are softened or melted, and the outer shell wall OS is also softened or melted. The energized heating elements penetrate into the microcapsule layer 64, and apply the pressure $P_2$ (1.0 MPa) involving a shearing force to the pressure-sensitive microcapsules 66C and 66M, and the heat-sensitive microcapsule 66Y as shown in FIG. 22. The pressure-sensitive microcapsule 66M is broken under such a condition to release the magenta coloring composition, thereby producing magenta dots.

When the pressure-sensitive, heat-sensitive recording medium 60 is conveyed between the third thermal head 30Y and the third roller platen 32Y, to the microcapsule layer 64 thereof is applied the breaking pressure $P_1$ of 0.01 MPa involving a shearing force by the third pressure-applying spring 34Y through the heating elements $R_{y1}$, $R_{y2}$, $R_{y3}$, . . . , $R_{yn}$ of the third thermal head 30Y. The breaking pressure $P_1$ is obstructed by the stonewall structure of the binder particles and cannot directly reach the pressure-sensitive microcapsules 66C and 66M, and the heat-sensitive microcapsule 66Y.

If any of the heating elements $R_{y1}$, $R_{y2}$, $R_{y3}$, . . . , $R_{yn}$ of the third thermal head 30Y is electrically energized, the energized heating elements are heated to a temperature $T_3$ (170° C.) higher than the melting temperatures of the binder particles 70 and the outer shell wall OS (73° C. and 108° C.), and the primary azeotropic point of the yellow coloring composition contained in the heat-sensitive microcapsule 66Y (150° C.). The binder particles 70 corresponding to the energized heating elements are softened or melted, whereby the stonewall structure of the microcapsule layer 64 is partially broken. The energized heating elements penetrate into the microcapsule layer 64, and apply the pressure $P_1$ (0.01 MPa) involving a shearing force to the pressure-sensitive microcapsules 66C and 66M, and the heat-sensitive microcapsule 66Y as shown in FIG. 22. As described above, the heat-sensitive microcapsule 66Y is broken by the rapidly increased inner pressure thereof under such a condition to release the yellow coloring composition, thereby producing yellow dots.

Various changes and modifications mentioned above with regard to the third recording medium of the present invention may be made in the sixth recording medium of the present invention without departing from the spirit and scope thereof.

The outer shell wall OS may be made of a material having an appreciate melting point such as ethyl p-hydroxybenzoate (melting point: 115 to 118° C.) as well as the wax mentioned above. The outer shell wall OS of ethyl p-hydroxybenzoate may be formed by dispersing the pressure-sensitive microcapsule 18M in an ethyl p-hydroxybenzoate solution to deposit ethyl p-hydroxybenzoate on the surface of the microcapsule 18M.

Further, properties of the inner shell wall IS and the outer shell wall OS may be reversed. Thus, the inner shell wall IS may be made of a wax, and the outer shell wall OS may be made of an amino resin.

As described in detail above, a first heat-sensitive microcapsule of the present invention is stable to light and easy to handle. A second heat-sensitive microcapsule of the present invention can be sensitively broken even by heating in a short time. Recording mediums of the present invention using the first or second heat-sensitive microcapsule provides substantially no waste products after recording, and is easy to handle. On the recording mediums of the present invention can be sensitively and economically recorded an image with ease by selecting recording temperature and recording pressure. The present disclosure relates to subject matter contained in Japanese Patent Application No. 11-348908 (filed on Dec. 8, 1999) and Japanese Patent Application No. 2000-121552 (filed on Apr. 21, 2000) which are expressly incorporated herein by reference in its entirety.

What is claimed is:

1. A heat-sensitive microcapsule comprising a shell wall and a liquid coloring composition enclosed in said shell wall, wherein said heat-sensitive microcapsule has such a temperature-breaking characteristic that said shell wall is broken by heating to a temperature equal to or higher than a boiling point of said liquid coloring composition to release said liquid coloring composition.

2. The heat-sensitive microcapsule according to claim 1, wherein said liquid coloring composition contains a liquid vehicle and a coloring matter dispersed or dissolved in said liquid vehicle.

3. The heat-sensitive microcapsule according to claim 2, wherein said liquid vehicle is a transparent oil.

4. The heat-sensitive microcapsule according to claim 3, wherein said transparent oil is a high-boiling point oil.

5. The heat-sensitive microcapsule according to claim 4, wherein said high-boiling point oil is composed of at least two oils having different boiling points.

6. The heat-sensitive microcapsule according to claim 1, wherein said shell wall is made of a thermosetting resin or a high-melting point thermoplastic resin.

7. A pressure-sensitive, heat-sensitive recording medium comprising a substrate coated with a microcapsule layer, wherein said microcapsule layer includes a plurality of pressure-sensitive microcapsules and a plurality of heat-sensitive microcapsules uniformly distributed in a binder having a predetermined melting temperature, said pressure-sensitive microcapsules each containing a first coloring composition, said heat-sensitive microcapsules each containing a second coloring composition, said pressure-sensitive microcapsule is broken under a predetermined pressure at a first temperature higher than the melting temperature of said binder, and said heat-sensitive microcapsule has such a temperature-breaking characteristic that said heat-sensitive microcapsule is broken by heating to a second temperature higher than said first temperature to release said second coloring composition.

8. The pressure-sensitive, heat-sensitive recording medium according to claim 7, wherein said second coloring composition has a boiling point higher than said first temperature, and said heat-sensitive microcapsule has such a temperature-breaking characteristic that said heat-sensitive microcapsule is broken by heating to a temperature equal to or higher than said boiling point to release said second coloring composition.

9. The pressure-sensitive, heat-sensitive recording medium according to claim 8, wherein said second coloring composition contains a liquid vehicle and a coloring matter dispersed or dissolved in said liquid vehicle.

10. The pressure-sensitive, heat-sensitive recording medium according to claim 9, wherein said liquid vehicle comprises at least a compound for controlling said boiling point of said second coloring composition.

11. The pressure-sensitive, heat-sensitive recording medium according to claim 9, wherein said coloring matter is a leuco-dye, said binder comprising a color-developing agent for said leuco-dye.

12. The pressure-sensitive, heat-sensitive recording medium according to claim 7, wherein an average diameter of said heat-sensitive microcapsules is smaller than an average diameter of said pressure-sensitive microcapsules.

13. The pressure-sensitive, heat-sensitive recording medium according to claim 7, wherein spacer particles having an average diameter larger than said average diameter of said pressure-sensitive microcapsules are uniformly distributed in said microcapsule layer.

14. The pressure-sensitive, heat-sensitive recording medium according to claim 13, wherein said spacer particles are made of an inorganic material or a high-melting point synthetic resin.

15. The pressure-sensitive, heat-sensitive recording medium according to claim 7, wherein said microcapsule layer has a stonewall structure where said binder is composed of binder particles fused to each other.

16. The pressure-sensitive, heat-sensitive recording medium according to claim 7, wherein said first coloring compositions contains a vehicle and a coloring matter dispersed or dissolved in said vehicle.

17. The pressure-sensitive, heat-sensitive recording medium according to claim 16, wherein said coloring matter is a leuco-dye, said binder comprising a color-developing agent for said leuco-dye.

* * * * *